US008151402B2

(12) United States Patent
Takabayashi et al.

(10) Patent No.: US 8,151,402 B2
(45) Date of Patent: Apr. 10, 2012

(54) CLEANING ARTICLE, METHOD OF FLUFFING CLEANING ARTICLE, AND METHOD OF PRODUCING CLEANING ARTICLE

(75) Inventors: Keima Takabayashi, Tochigi (JP); Minoru Wada, Tochigi (JP); Chiharu Omori, Tochigi (JP); Akihito Shizuno, Tochigi (JP)

(73) Assignee: Kao Corporation, Tokyo (JP)

( * ) Notice: Subject to any disclaimer, the term of this patent is extended or adjusted under 35 U.S.C. 154(b) by 1091 days.

(21) Appl. No.: 11/884,130

(22) PCT Filed: Nov. 8, 2006

(86) PCT No.: PCT/JP2006/322252

§ 371 (c)(1),
(2), (4) Date: Aug. 10, 2007

(87) PCT Pub. No.: WO2007/102254

PCT Pub. Date: Sep. 13, 2007

(65) Prior Publication Data

US 2010/0154156 A1 Jun. 24, 2010

(30) Foreign Application Priority Data

Mar. 9, 2006 (JP) ..... 2006-64304
Jun. 1, 2006 (JP) ..... 2006-153163

(51) Int. Cl.
*A47L 13/12* (2006.01)
*A47L 13/20* (2006.01)
*A47L 13/38* (2006.01)

(52) U.S. Cl. ..... 15/229.3; 15/209.1; 15/226; 15/227; 15/229.1; 15/229.4

(58) Field of Classification Search ..... 15/209.1, 15/226, 229.1, 229.3, 229.7, 227, 229.4; 33/209.1
See application file for complete search history.

(56) References Cited

U.S. PATENT DOCUMENTS 333,650 A 1/1886 Mason (Continued)

FOREIGN PATENT DOCUMENTS

CN 1350442 A 5/2002

(Continued)

OTHER PUBLICATIONS

Notice of Rejection mailed Jun. 29, 2010 in Japanese Application No. 2006-281743.

(Continued)

*Primary Examiner* — Randall Chin
(74) *Attorney, Agent, or Firm* — Birch, Stewart, Kolasch & Birch, LLP

(57) ABSTRACT

A cleaning article 10 having a flat tubular pocket 15 and attachable to a holder by inserting the holder into the pocket 15. The pocket 15 is formed by joining pocket-forming sheets 13 facing each other. At least one fiber layer formed of a fiber bundle, accordingly two fiber layers 11A and 11B are provided on each of the upper and lower sides of the pocket 15 of the pocket-forming sheets 13. Each of the first fiber layers 11A closest to the pocket-forming sheets 13 is joined to the respective pocket-forming sheet 13 by a continuous central linear seal 16A continuously extending in the longitudinal direction in a laterally middle portion and a discontinuous side seal 16B discontinuously extending in the longitudinal direction at a position laterally spaced away in at least one of the lateral directions from the central continuous linear seal 16A.

5 Claims, 20 Drawing Sheets

U.S. PATENT DOCUMENTS

| | | | | |
|---|---|---|---|---|
| 534,839 | A | 2/1895 | Nelsen | |
| 597,158 | A | 1/1898 | Willey | |
| 810,708 | A | 1/1906 | Brister | |
| 974,922 | A | 11/1910 | Rose | |
| 975,862 | A | 11/1910 | Hatosy | |
| 1,375,102 | A | 4/1921 | Masser | |
| 1,416,480 | A | 5/1922 | Leatherman | |
| 1,437,145 | A * | 11/1922 | Johnson | 15/210.1 |
| 1,637,595 | A | 8/1927 | Sturgis | |
| 2,062,065 | A * | 11/1936 | Miley | 15/210.1 |
| 2,151,425 | A | 3/1939 | Gregory | |
| 2,172,479 | A | 9/1939 | McMillen | |
| D151,623 | S | 11/1948 | Heller | |
| 2,816,313 | A | 12/1957 | Beck et al. | |
| 2,998,614 | A | 9/1961 | Winch | |
| 3,066,344 | A | 12/1962 | Borras | |
| D226,886 | S | 5/1973 | Codina | |
| 4,099,289 | A | 7/1978 | Bretthauer | |
| D294,073 | S | 2/1988 | Lin | |
| D320,878 | S | 10/1991 | Linder | |
| D350,029 | S | 8/1994 | Murphy et al. | |
| D353,489 | S | 12/1994 | Hurwitz | |
| D353,940 | S | 1/1995 | Joyner et al. | |
| 5,605,941 | A | 2/1997 | Steinmann et al. | |
| 5,953,784 | A | 9/1999 | Suzuki et al. | |
| D435,948 | S | 1/2001 | Long | |
| 6,329,308 | B1 | 12/2001 | Kenmochi et al. | |
| 6,978,509 | B2 * | 12/2005 | Lin | 15/229.7 |
| D515,319 | S | 2/2006 | Ashley et al. | |
| D530,051 | S | 10/2006 | Treacy | |
| 7,219,386 | B2 | 5/2007 | Tsuchiya et al. | |
| 7,293,317 | B2 | 11/2007 | Tsuchiya et al. | |
| 7,739,770 | B2 | 6/2010 | Tanaka et al. | |
| 7,779,502 | B2 | 8/2010 | Fujiwara et al. | |
| 7,786,030 | B2 | 8/2010 | Tsuchiya | |
| 7,937,797 | B2 | 5/2011 | Tsuchiya et al. | |
| 2002/0148061 | A1 | 10/2002 | Tanaka et al. | |
| 2004/0016074 | A1 | 1/2004 | Tanaka | |
| 2004/0034956 | A1 | 2/2004 | Tanaka et al. | |
| 2005/0005381 | A1 | 1/2005 | Tanaka et al. | |
| 2006/0016036 | A1 | 1/2006 | Tanaka et al. | |
| 2006/0171764 | A1 | 8/2006 | Hoadley | |
| 2006/0230560 | A1 | 10/2006 | Sampaio | |
| 2006/0282969 | A1 | 12/2006 | Yamada | |
| 2007/0113365 | A1 | 5/2007 | Parkinson | |
| 2007/0174987 | A1 | 8/2007 | Yamada | |

FOREIGN PATENT DOCUMENTS

| | | | |
|---|---|---|---|
| CN | 1386059 | A | 12/2002 |
| CN | 1628591 | A | 6/2005 |
| DE | 103607455 | A1 | 7/2005 |
| EP | 1201175 | A1 | 5/2002 |
| GB | 1417293 | | 12/1975 |
| JP | 48-30851 | A | 9/1973 |
| JP | 51-21542 | A | 6/1976 |
| JP | 461574 | | 11/1977 |
| JP | 55-45980 | A | 3/1980 |
| JP | 55-45980 | U | 3/1980 |
| JP | 578348 | S | 6/1982 |
| JP | 57-160457 | A | 10/1982 |
| JP | 724281 | S | 2/1988 |
| JP | 2-4541 | U | 1/1990 |
| JP | 3-58260 | U | 6/1991 |
| JP | 877507 | S | 9/1993 |
| JP | 6-294167 | A | 10/1994 |
| JP | 9-135798 | A | 5/1997 |
| JP | 3043196 | U | 8/1997 |
| JP | 10-248781 | A | 9/1998 |
| JP | 3053594 | U | 11/1998 |
| JP | 11-47059 | A | 2/1999 |
| JP | 2001-276125 | A | 10/2001 |
| JP | D1145957 | S | 7/2002 |
| JP | 2002-369783 | A | 12/2002 |
| JP | 2003-265390 | A | 9/2003 |
| JP | 2004-298650 | A | 10/2004 |
| JP | 2005-137931 | A | 6/2005 |
| JP | 2005-237589 | A | 9/2005 |
| JP | 2005-237591 | A | 9/2005 |
| JP | 2005-237975 | A | 9/2005 |
| JP | 2005-261731 | A | 9/2005 |
| WO | WO-02/34101 | | 5/2002 |
| WO | WO 2005/092171 | A1 | 10/2005 |
| WO | WO-2005/099549 | A1 | 10/2005 |
| WO | WO 2006/011234 | A1 | 2/2006 |

OTHER PUBLICATIONS

Extended European Search Report dated May 11, 2010 for corresponding European Application No. 06823156.2.

Japanese Notice of Rejection mailed Jun. 8, 2010 for corresponding Japanese Application No. 2006-064304.

Search Report and Written Opinion mailed Aug. 19, 2010 in Singapore Application No. 200705798-7.

European Extended Search Report in European Application No. 06811378.6 mailed Apr. 1, 2010.

Extended European Search Report in European Application No. 06811379.4 mailed May 6, 2010.

Notice of Rejection in Japanese Application No. 2005-305697 mailed Apr. 27, 2010.

Notice of Rejection in Japanese Application No. 2006-186230 mailed Jun. 29, 2010.

Office Action in Chinese Application No. 2006800390114 mailed Jul. 24, 2009.

Singapore Search Report in Singapore Application No. 2008027864 mailed May 28, 2009.

Singapore Search Report in Singapore Application No. 2008028375 mailed Jul. 2, 2009.

Chinese Office Action dated Nov. 27, 2009 in corresponding Chinese Application No. 200680004373.X.

Japanese Decision of Refusal for Application No. 2006-186230, dated Mar. 1, 2011.

Japanese Office Action issued on Mar. 29, 2011 in Japanese Patent Application No. 2006-064304.

Singapore Written Opinion and Search Report for Application No. 200705798-7 dated May 28, 2010.

U.S. Notice of Allowance for U.S. Appl. No. 29/270,555 dated Apr. 29, 2008.

U.S. Notice of Allowance for U.S. Appl. No. 29/270,556 dated Apr. 29, 2008.

U.S. Office Action for U.S. Appl. No. 11/884,130 dated Aug. 24, 2011.

U.S. Office Action for U.S. Appl. No. 11/884,130 dated Feb. 9, 2011.

U.S. Office Action for U.S. Appl. No. 11/884,130 dated Mar. 16, 2011.

U.S. Office Action for U.S. Appl. No. 12/083,837 dated Jun. 13, 2011.

U.S. Office Action for U.S. Appl. No. 29/270,557 dated Apr. 24, 2008.

European Office Action for Application No. 06823156.2 dated Jan. 24, 2012.

Office Action for European Patent Application No. 06811376.6, dated Jan. 27, 2012.

* cited by examiner

CLEANING ARTICLE, METHOD OF FLUFFING CLEANING ARTICLE, AND METHOD OF PRODUCING CLEANING ARTICLE

TECHNICAL FIELD

The present invention relates to a cleaning article having a holder-receiving pocket and attachable to a holder by inserting the holder into the pocket, a method of fluffing the cleaning article, and a method of producing the cleaning article.

BACKGROUND ART

Cleaning articles having a holder-receiving pocket (hereinafter simply referred to as a pocket) and attachable to a holder by inserting the holder into the pocket are known, e.g., from Patent Document mentioned below Cleaning articles having a fiber layer formed of a fiber bundle on both the upper and lower sides of a substrate sheet are also known. The fiber layer is generally bonded to the substrate sheet by a plurality of continuous linear seals as disclosed, e.g., in Patent Documents 2 and 3.

Cleaning articles having a fiber layer formed of a fiber bundle on one side of a substrate sheet are also known, in which the fiber layer and the substrate sheet are bonded by linear bonding and discontinuous dot bonding, as disclosed in Patent Document 4.

Patent Document 1: JP 2003-265390A
Patent Document 2: JP 9-135798A
Patent Document 3: JP 2002-369783A
Patent Document 4: WO 2005/099549

DISCLOSURE OF THE INVENTION

Since the cleaning article of Patent Document 2 has the fiber layer bonded to the substrate sheet by a plurality of continuous linear seals, the fiber layer is inferior in rising or fluffing capabilities and recovery from compression in a cleaning operation. Therefore, the article has poor conformability to an uneven surface of an object to be cleaned, namely poor cleaning performance.

The cleaning article of Patent Document 3 includes strips in addition to the fiber layer and the substrate sheet so that the fiber bundle fails to make effective contribution to cleaning.

The cleaning article of Patent Document 4, having a fiber layer on only one side, is useful for cleaning purposes on only one side thereof, which makes a cleaning operation cumbersome. In other words, convenience of use is not taken into due consideration.

The present invention provides a cleaning article the fiber layers of which exhibit high fluffing capabilities and recovery from compression, which is highly conformable to an uneven surface of an object being cleaned, is given due consideration for user's convenience, and is superior in cleaning performance. The present invention also provides a method of fluffing the cleaning article and a method of producing the cleaning article.

The present invention provides a cleaning article having a flat tubular pocket and attachable to a holder by inserting the holder into the pocket. The pocket is formed by joining pocket-forming sheets facing each other. The cleaning article has at least one fiber layer formed of a fiber bundle on each of the upper and lower sides of the pocket of the pocket-forming sheets. The fiber layers closest of all the fiber layers to the pocket-forming sheets (hereinafter referred to as "first fiber layers") are joined to the respective pocket-forming sheets by a continuous central linear seal continuously extending in the longitudinal direction in a laterally middle portion and a discontinuous side seal discontinuously extending in the longitudinal direction at a position laterally spaced away in at least one of the lateral directions from the central continuous linear seal.

The present invention also provides a method of fluffing a cleaning article having a flat tubular pocket and a fiber layer formed of a fiber bundle bonded to each of the upper and lower sides of the pocket by a continuous central linear seal. The cleaning article is adapted to be attached to a holder by inserting the holder into the pocket. The fluffing method includes splitting the fiber layers each formed of the fiber bundle to fluff the fiber layers randomly in three dimensions into an almost cylindrical shape hiding the continuous central linear seals.

The present invention also provides a method of producing a cleaning article including the steps of (1) preparing a first continuous form subassembly having a first member of continuous form and a first fiber layer formed of a continuous fiber bundle fixedly overlaid on the outer side of the first member, the first member of continuous form having both the side edges thereof folded over and fixed to itself, and a second continuous form subassembly having a second member of continuous form and a third fiber layer formed of a continuous fiber bundle fixedly overlaid on the outer side of the second member, the second member of continuous form having both side edges thereof folded over and fixed to itself, (2) mating and joining the first and second continuous form subassemblies to each other and overlaying a second fiber layer and a fourth fiber layer each formed of a continuous fiber bundle on the first and second continuous form subassemblies, respectively, and (3) cutting the resulting continuous form assembly into individual cleaning articles. The first and second members each consist of middle portions each sandwiched between a pair of tear-off lines and tear-off portions each connecting to every middle portion via each of the tear-off lines. The method comprises the steps of (a) forming pairs of the tear-off lines extending transversely across each of the first and second members at intervals, (b) forming continuous central linear seals in the first and second continuous form subassemblies at intervals in the machine direction, the continuous central linear seals extending transversely across the first fiber layer and the third fiber layer, (c) forming discontinuous side seals in the first and second continuous form subassemblies at intervals in the machine direction, the discontinuous side seals extending transversely across the first fiber layer and the third fiber layer, (d) tearing off the tear-off portions from the first and second members along the tear-off lines to leave the middle portion sandwiched between every pair of the tear-off lines, and (e) splitting the fiber layers to fluff up randomly in three dimensions.

BRIEF DESCRIPTION OF THE DRAWINGS

FIG. 4(*b*) is a cross-sectional view taken along line IVB-IVB in FIG. 3.

FIG. 7(*b*) is a vertical cross-sectional view of pocket-forming sheets in a second embodiment of the cleaning article according to the present invention, taken in the lateral direction (corresponding to FIG. 4(*b*)).

FIG. 13(*b*) is a cross-sectional view taken along line IVB-IVB in FIG. 12.

FIG. 13(*c*) is an exploded cross-sectional view of the cleaning article of FIG. 10.

FIG. 15(*b*) is a vertical cross-sectional view of the first member shown in FIG. 15(*a*), taken in the lateral direction thereof.

FIG. 16(*b*) is a vertical cross-sectional view of the first subassembly of FIG. 16(*a*), taken in the lateral direction thereof.

FIG. 17(*b*) is a vertical cross-sectional view of the stack of FIG. 17(*a*), taken in the lateral direction thereof.

FIG. 18(*b*) is a vertical cross-sectional view of the assembly shown in FIG. 18(*a*), taken in the lateral direction thereof.

FIG. 20(*b*) is a vertical cross-sectional view of the cleaning article illustrated in FIG. 20(*a*), taken in the lateral direction thereof.

FIG. 22(*b*) is an exploded cross-sectional view of the pocket-forming sheets of the embodiment of FIG. 22(*a*), taking in the longitudinal direction thereof.

MODE FOR CARRYING OUT THE INVENTION

Figure 1:
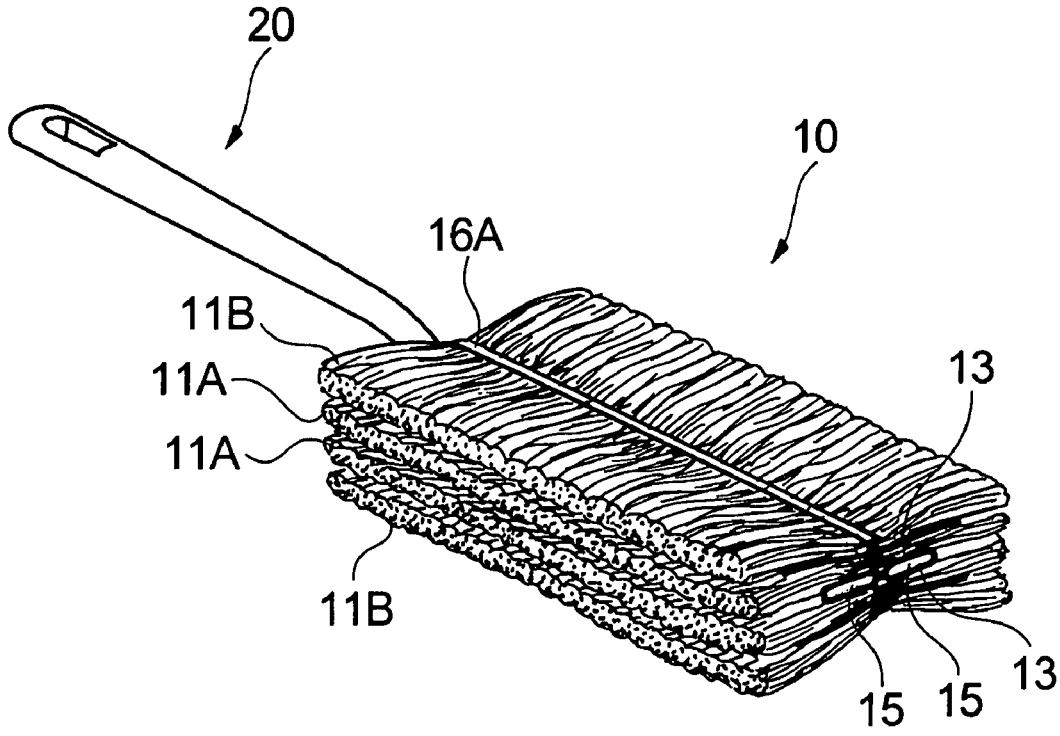
FIG. 1 is a perspective view of a first embodiment of the cleaning article according to the present invention, attached to a holder.
Figure 2:
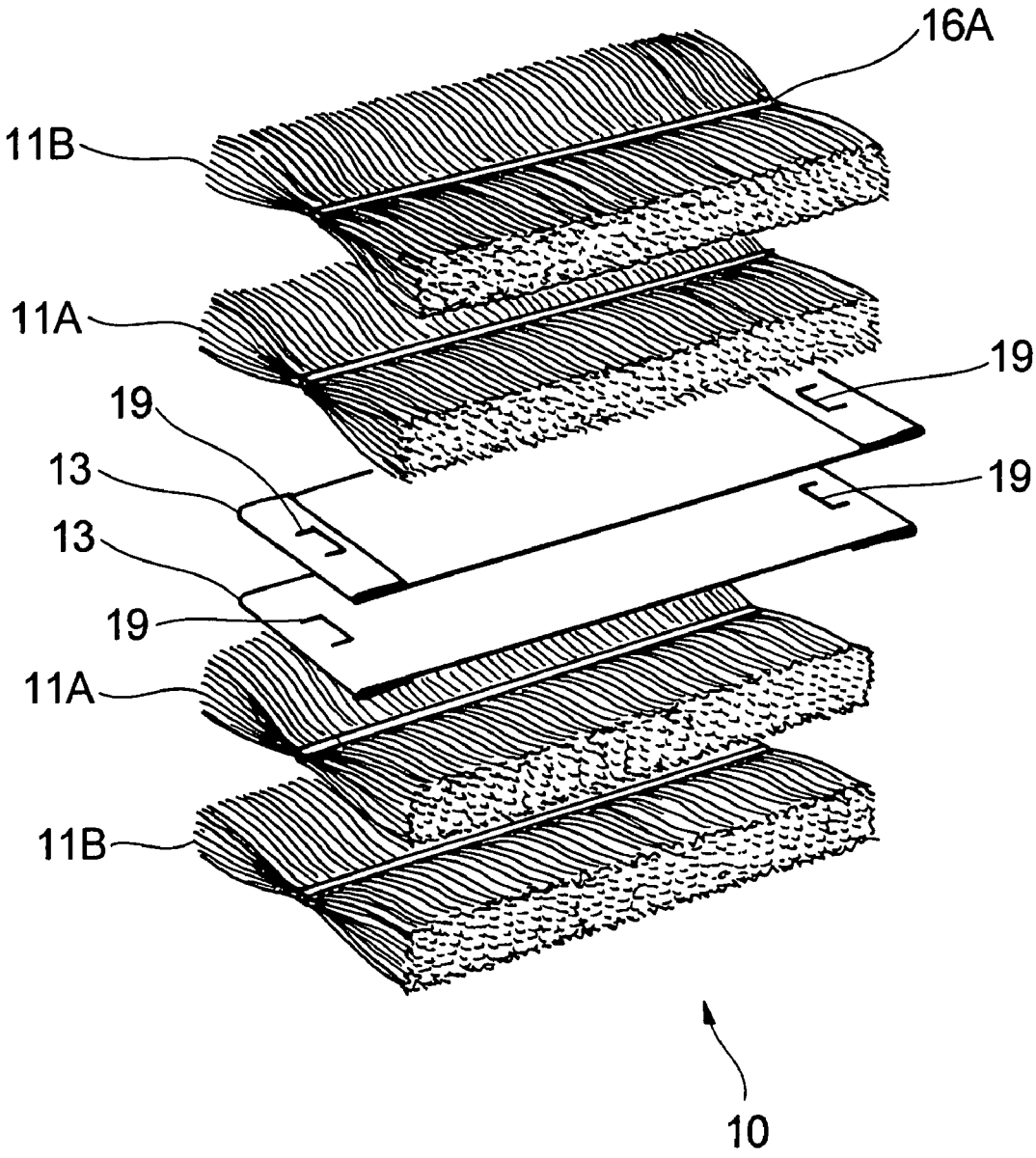
FIG. 2 is an exploded perspective view of the cleaning article of FIG. 1.
Figure 3:
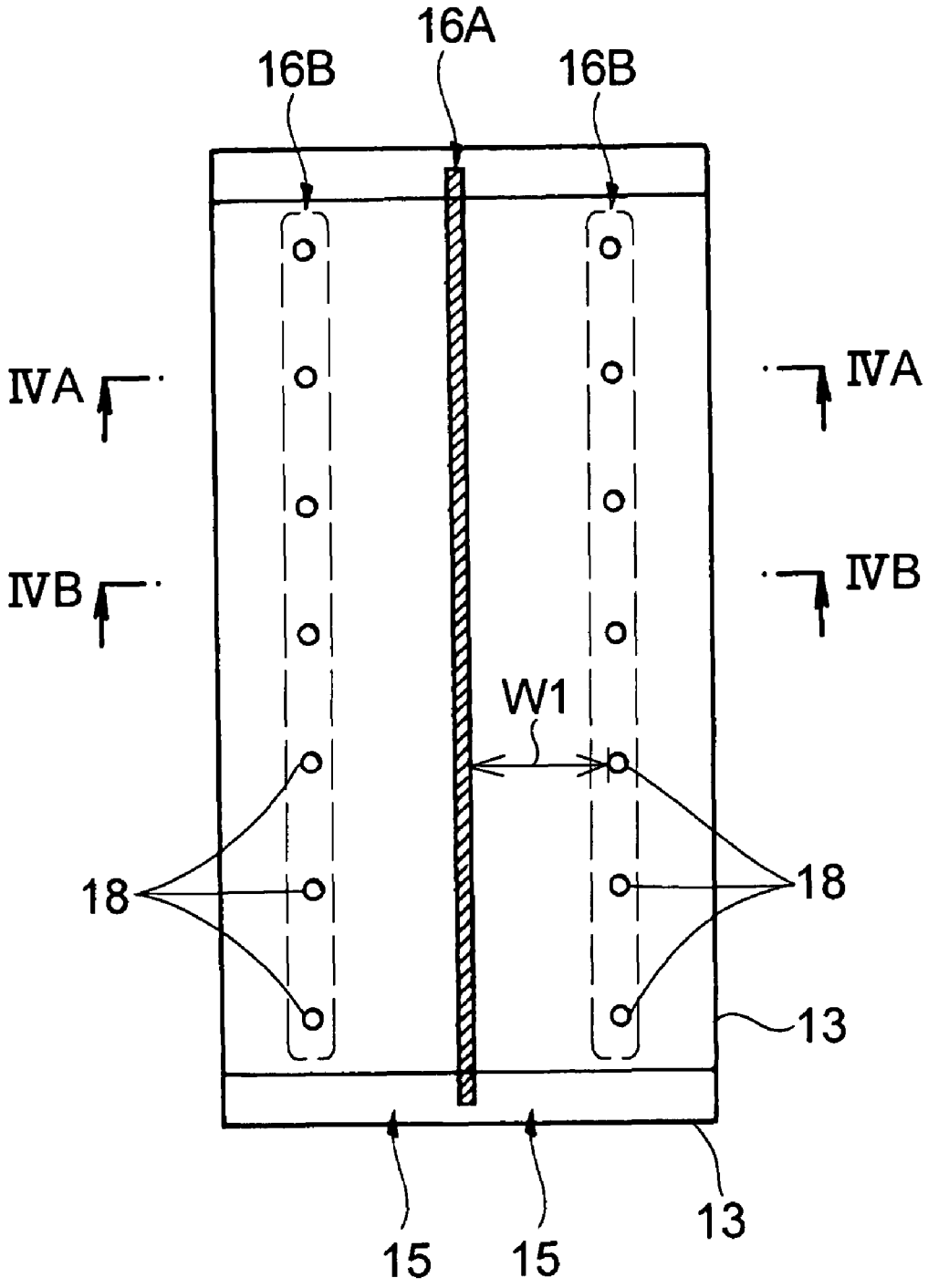
FIG. 3 is a plan view of pocket-forming sheets of the cleaning article of FIG. 1.

The cleaning article of the present invention will be described based on its first preferred embodiment with reference to the accompanying drawings.

As illustrated in FIGS. 1 through 4(*b*), the cleaning article (hereinafter referred to as "mop") 10 according to the first embodiment is oblong and flat as a whole and has a pair of flat tubular pockets 15 adjacent in the lateral direction thereof. The mop 10 of the first embodiment is attachable to a holder having a pair of insertion portions 22 (described later in detail) by inserting the paired insertion portions 22 into the paired pockets 15.

In what follows, the terms "longitudinal direction" and "lateral direction" means the longitudinal direction (the direction of insertion) and lateral direction, respectively, of the pockets 15 unless otherwise noted.

The pockets 15 are formed by joining two facing pocket-forming sheets 13 by a continuous central linear seal 16A and discontinuous side seals 16B at prescribed positions (described later in detail).

At least one fiber layer 11 formed of a fiber bundle is disposed on both the upper and lower sides of the pockets 15, i.e., the facing pocket-forming sheets. In this particular embodiment, two fiber layers 11, i.e., a first fiber layer 11A and a second fiber layer 11B are disposed on each of the upper and lower sides of the pockets 15. Numerical reference 11 will be used in describing particulars common to the first fiber layer 11A and the second fiber layer 11B.

The first fiber layers 11A are closer to the pocket-forming sheets 13 than any other fiber layers 11. The second fiber layers 11B are each a fiber layer present on the outer side of the first fiber layer 11A. Accordingly, the mop 10 of the first embodiment has a stack of four fiber layers, i.e., the second fiber layer 11B and the first fiber layer 11A on the upper side of the pockets and the first fiber layer 11A and the second fiber layer 11B on the lower side of the pockets 14 in the order from the upper to lower sides.

The fiber layers 11 are each formed of an oriented fiber bundle with a prescribed thickness. The fiber bundle is substantially oriented in the lateral direction of the pockets 15. Accordingly, the first fiber layers 11A and the second fiber layers 11B are stacked with the fiber orientation direction substantially perpendicular to the longitudinal direction of the pocket-forming sheets 13. The fiber layers 11 are each a nearly rectangular in a plan view and of substantially the same shape.

The fibers constituting the fiber layers 11 preferably have a length of 30 to 150 mm, more preferably 50 to 120 mm, in view of dust trapping capabilities. In the present embodiment, fibers having such a length are used in the form of a fiber bundle (tow). It is preferred that the tow be sufficiently splitted with a known splitting device beforehand.

While the thickness of the fibers is not particularly limited, it is preferred to use fibers having a thickness of 0.1 to 200 dtex, preferably 2 to 30 dtex, to secure dust trapping capabilities and prevent scratches on a surface of an object being cleaned.

It is particularly preferred to use crimped fibers to provide fiber layers 11 with further improved dust trapping capabilities. Two-dimensionally or three-dimensionally crimped fibers can be used. The percentage of crimp (JIS L0208) is preferably 5% to 50%, more preferably 10% to 30%, to obtain improved dust trapping capabilities. The percentage of crimp is defined to be a percentage of a difference between the length A of a crimped fiber in its straightened state and the natural length B of the crimped fiber to the length A, being calculated from equation:

$$\text{Percentage of crimp}(\%)=(A-B)/A\times 100$$

The natural length B is the length of the straight line connecting the two ends of a crimped fiber in its natural state. The term "natural state" means a state of a crimped fiber hanging under its own weight with its one end fixed to a horizontal plate. The term "length A in a straightened state" means the length of a crimped fiber stretched out until no crimp remains under a minimum load.

The percentage of crimp falling within the range recited above, the number of crimps is preferably 2 to 20, more preferably 2 to 10, per centimeter. The number of crimps is measured in accordance with JIS L1015 8.12.1.

The pocket-forming sheets 13 are almost rectangular with their longitudinal direction coinciding with the longitudinal direction of the mop 10. The pocket-forming sheets 13 are almost as long as the fiber layers 11 and narrower than the fiber layers 11.

The pocket-forming sheets 13 are flexible in their longitudinal direction and easily conformable to the contour of an object being cleaned. As a result, the fiber layers 11 joined to the pocket-forming sheets 13 are also conformable to the contour of an object being cleaned to produce improved dust and dirt trapping effects.

The material forming the pocket-forming sheets 13 can be any of fibrous sheets such as nonwovens historically employed in conventional cleaning articles. Air-through nonwovens and spun-bonded nonwovens are particularly preferred.

The fiber layers 11 and the pocket-forming sheets 13 are stacked with their longitudinal centerlines aligned and joined together over the length of the pocket-forming sheets 13.

In more detail, the first fiber layers 11A are joined to the respective pocket-forming sheets 13 by a continuous central linear seal 16A continuously extending in the longitudinal direction in a laterally middle portion and by a pair of discontinuous side seals 16B discontinuously extending in the longitudinal direction and laterally spaced away in both lateral directions from the central linear seal 16A.

The second fiber layers 11B are bonded to the respective pocket-forming sheets 13 only by the continuous central linear seal 16A in the laterally middle portion.

The continuous central linear seal 16A located in the laterally middle portion of the mop 10 is continuous, straight-linear and spans opposite longitudinal ends of the pocket-forming sheets 13. The lateral position of the continuous central linear seal 16A can also be said to be the laterally middle portion of the pocket-forming sheets 13.

In order for the tips of the fibers contributory to cleaning be present on the entire surface of the mop, the lateral position of the continuous central linear seal 16A is preferably such that divides the width of the pocket-forming sheet 13 at a ratio of 2:8 to 8:2, more preferably at a ratio of 4:6 to 6:4.

At least one of the two pocket-forming sheets 13 has a length of 100% or more of the length of the first fiber layers 11A or of the second fiber layers 11B in the direction of insertion into the pockets 15. In view of ease of checking the position of inserting a holder 20 and ease of inserting the holder, it is preferred that both of the two pocket-forming sheets 13 be longer than the first fiber layers 11A or the second fiber layers 11B. It is preferred that the longitudinal end of the pocket-forming sheet 13 extend outward from the longitudinal end of the first fiber layers 11A or the second fiber layers 11B by 1 to 40 mm, more preferably 1 to 30 mm.

When a user uses the mop 10 for cleaning while grasping the holder 20, it is likely that only the distal portion of the mop 10 is soiled. Noting this tendency and in order to make full use of the entire cleaning surface, it is effective to provide the mop 10 with another pair of inlets for inserting the holder 20 from the opposite direction to the insertion direction illustrated in FIG. 1, i.e., from the right to the left in FIG. 1. The mop 10 of the first embodiment has that structure as described later. In that case, it is preferred that the pocket-forming sheets 13 extend outward from the first fiber layers 11A or the second fiber layers 11B at both longitudinal ends thereof.

In the extensions from the first fiber layers 11A or the second fiber layers 11B, the pocket-forming sheets 13 preferably remain unjoined together by at least 1 mm, more preferably 5 mm or longer, to provide ease of attachment.

A discontinuous side seal 16B (the zone encircled by broken line in FIG. 3) is provided at each outward position in the lateral directions of the continuous central linear seal 16A.

The discontinuous side seal 16B consists of 2 to 100 dot joints spacedly aligned in the longitudinal direction. The number of the dot joints making up the discontinuous seal is preferably 2 to 50. In this particular embodiment, the dot joints 18 are circular, heat-sealed joints that are equally spaced in the longitudinal direction. The positions of the dot joints 18 in the longitudinal direction are symmetrical about the longitudinal centerline of the pocket-forming sheets. To avoid a holder 20 catching in the spaces between the dot joints 18 in the longitudinal direction during inserting into the pockets 15, the distance between the dot joints in the longitudinal direction is preferably 5 to 40 mm.

The distance W1 (see FIG. 3) between the continuous central linear seal 16A and each of the discontinuous side seals 16B in the lateral direction is preferably 5 to 90 mm, more preferably 5 to 45 mm.

The distance W1 is a distance between the inboard edge of the individual dot joints 18 forming the discontinuous side seals 16B and the outboard edge of the continuous central linear seal 16A measured in the lateral direction of the pocket-forming sheets 13 overlying each other. In the first embodiment, the distance W1 is equal to the width of each pocket 15.

The total length of the dot joints 18 in each discontinuous side linear seal 16B (the length of the side seal 16B exclusive of the spaces between the dot joints 18 as measured in the longitudinal direction) is preferably 10% or more, more preferably 15% or more, of the length of the part of the first fiber layers 11A that overlies the pockets 15. The above-defined total length of the dot joints 18 is preferably 10% or more, more preferably 15% or more, of the length of the part of the continuous central linear seal 16A that is along beside the pockets 15.

The facing pocket-forming sheets 13 are not bonded to each other nor to the respective first fiber layers 11A in regions between every dot joints 18 of the discontinuous side seals 16B as will be described later in detail.

The shape of the individual dot joints 18 may be elliptic, rectangular, etc. The dot joints 18 may be spaced at irregular intervals in the longitudinal direction.

Figure 4A:
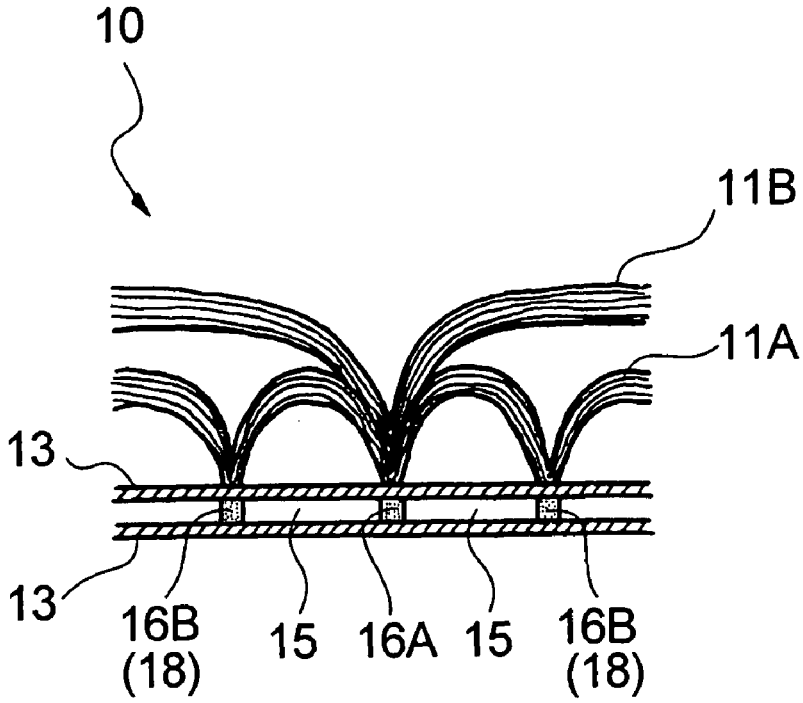
FIG. 4(*a*) is a cross-sectional view taken along line IVA-IVA in FIG. 3.
Figure 4B:
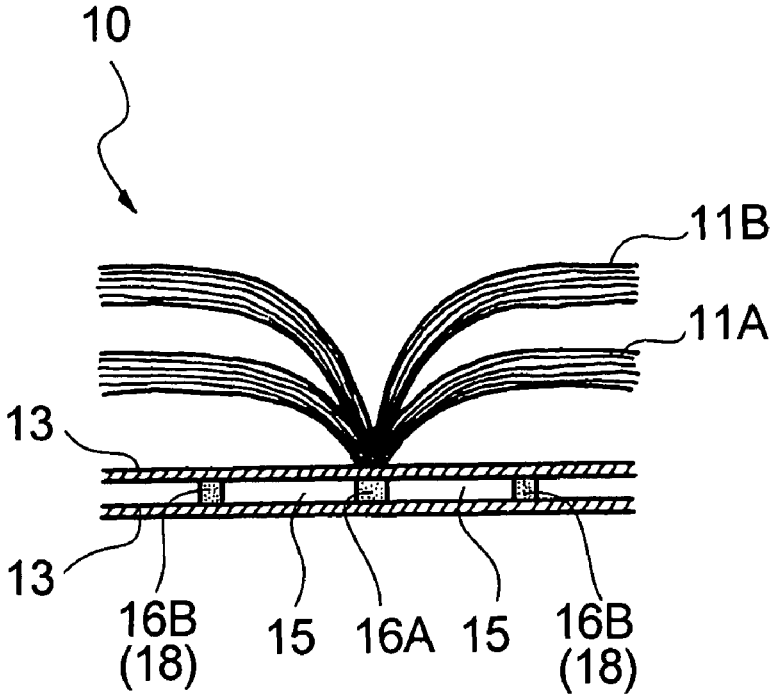

Seen in vertical cross-sectional views taken in the lateral direction, each first fiber layer 11A is joined to the pocket-forming sheet 13 at three joints—the central joint 16A and two side joints 16B —as represented by FIG. 4(*a*) or at only one joint—the central joint 16A —as represented by FIG. 4(*b*). Seen in a vertical transverse cross-sectional view taken along any plane in the lateral direction, each second fiber layer 11B is joined at only one joint—the central joint 16A —as illustrated in FIGS. 4(*a*) and 4(*b*).

Thus, the joint configuration is varied between the first fiber layer 11A and the second fiber layer 11B with respect to the pocket-forming sheet 13. As a result, the way of the fiber bundle (tow) being raised and fluffed varies between the fiber layers 11A and 11B even at the same central position (along the continuous central linear seal 16A). The first fiber layer 11A tends to rise obliquely, being suppressed from standing upright because of the existence of the second fiber layer 11B. The second fiber layer 11B, on the other hand, easily rises upright, being supported by the first fiber layer 11A next thereto. These tendencies of fiber rise will be described later in more detail.

The same effects on fiber rise could be achieved without varying the joint configuration but by merely increasing the amount of the fiber bundle per fiber layer. Nevertheless, this is liable to increase the cost and reduce the certainty of sealing, which can frequently cause the fibers to come off. To avoid such disadvantages, the above-described way of sealing varied between the fiber layers 11A and 11B is preferred. The expression "varied between fiber layers" as used herein does not always mean that two distinctive fiber layers but includes a single fiber bundle that is divided in its thickness direction into distinctive or indistinctive fiber layers to be sealed differently.

The continuous central linear seal 16A and the discontinuous side seals 16B are formed by known joining means such as heat sealing or adhesion with an adhesive. In the case where the pocket-forming sheets 13 are made out of heat fusible fibers, the continuous central linear seal 16A and the discontinuous side seals 16B can be formed by thermal fusion bonding.

The pair of flat tubular pockets 15 are formed by joining facing pocket-forming sheets 13 by the three seals—the discontinuous side seal 16B on one side, the continuous central linear seal 16A, and the discontinuous side seal 16B on the other side. That is, the three seals—the discontinuous side seal 16B on one side, the continuous central linear seal 16A, and the discontinuous side seal 16B on the other side—serve for sealing the facing pocket-forming sheet 13 not only with each other but with the fiber layers 11.

The pockets 15 are formed spans the whole length in the longitudinal ends of the pocket-forming sheets 13. The pair of pocket-forming sheets 13 are in contact with each other without a holder inserted therebetween. On inserting the holder 20 thereinto, the pocket-forming sheets 13 are separated apart to form a tubular space.

The pockets 15 each have an inlet formed at both longitudinal ends of the pocket-forming sheets 13 so that a holder 20 can be inserted into the pockets 15 from whichever inlet.

Figure 5:
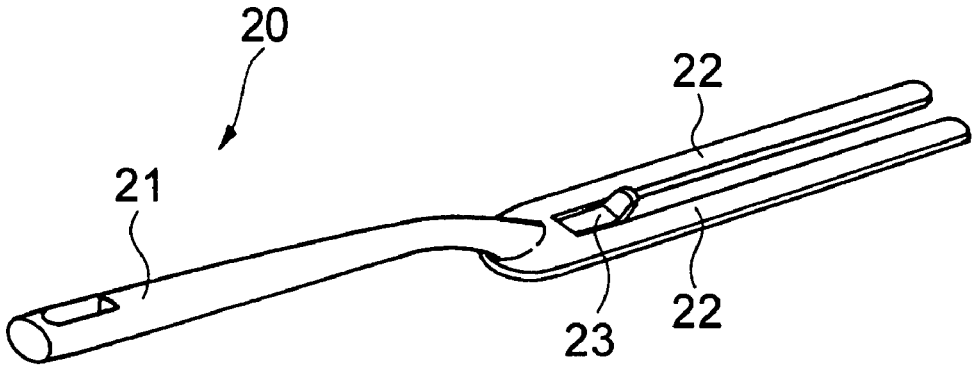
FIG. 5 is a perspective view of a holder.

As illustrated in FIG. 5, a holder 20 includes a handle 21 and a pair of insertion portions 22 forked from one end of the handle 21. The handle 21 and the insertion portions 22 make a prescribed angle. The insertion portions 22 each have a flat, strip shape. Being so designed, the insertion portions 22 are endowed with flexibility to help the mop 10 conform to a curved or uneven surface of an object to be cleaned and achieve increased efficiency of dust removal.

The paired insertion portions 22 are configured to be inserted into the respective paired pockets 15 of the mop 10. The holder 20 has a hook 23 shorter than the insertion portions 22 provided between the paired insertion portions 22. The hook 23 has its tip projecting upward at a certain angle. With the insertion portions 22 in the respective pockets 15, the hook 23 catches a slit cut 19 (described later) in the mop 10 to make the holder 20 less likely to come off the map 10.

Thermoplastic resins are preferably used to make the holder 20 for their moldability and flexibility. Examples of preferred thermoplastic resins include polyethylene, polypropylene, polyvinyl chloride, polystyrene, ABS (acrylonitrile-butadiene-styrene) resin, and acrylic resins.

The mop 10 of the first embodiment is used for cleaning as attached to the holder 20 with the paired insertion portions 22 of the holder 20 inserted into the respective pockets 15.

In order for the holder 20 to be inserted with ease but not to come off the mop 10 during a cleaning operation, it is preferred that the width of each pocket 15 be substantially equal to that of each insertion portion 22 of the holder 20. Having the insertion portion 22 therein, the pocket 15 expands laterally by the thickness of the insertion portion 22 and thereby constricts the insertion portion 22.

Each of the pocket-forming sheets 13 is folded back over its outer side to form a turnback cuff at both longitudinal ends thereof. The cuff is fixed to the outer side of the pocket-forming sheets 13 at its laterally middle position by the continuous central linear seal 16A.

Each of the pocket-forming sheets 13 has a slit cut 19 in both the longitudinal end portions thereof as an engaging means engageable with the hook 23 of the holder 20.

The slit 19 has the shape of a U letter. On engaging the slit 19 with the hook 23, the flap portion of the sheet 13 created by the U-shaped cutting is capable of opening upward and outward with respect to the longitudinal direction of the sheet 13. On engaging the slit 19 with the hook 23, the holder 20 is restricted from moving in the longitudinal direction in the pockets 15, particularly in the unsheathing direction. The mop 10 is thus stably held by the holder 20.

Since the slits 19 are cut in each of the facing pocket-forming sheets 13, the mop 10 can be attached to the holder 20 with the insertion portions 22 inserted into the respective pockets 15, whichever the hook 23 is on the upper side or the lower side of the mop 10.

While in the first embodiment the pockets 15 and the fiber layers 11 have substantially the same length (in the direction of insertion), there are cases, while not shown, in which it is preferred in view of ease of attachment that the pocket-forming sheets 13 be longer than the fiber layers 11 so that the pockets 15 may be longer than the fiber layers 11.

Figure 6:
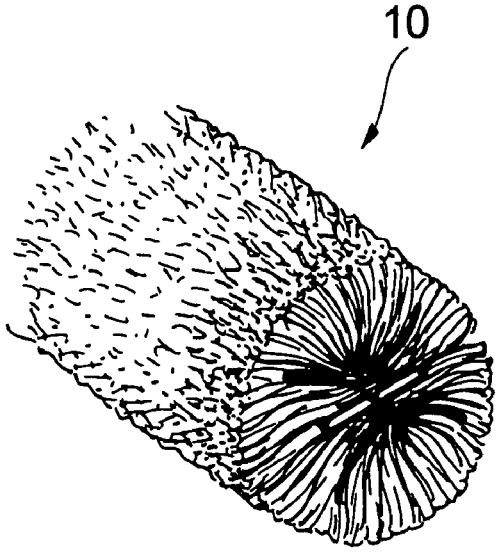
FIG. 6 is a perspective view of a cleaning article with fiber layers fluffed up.

As illustrated in FIG. 6, the mop of the present invention may have the fibers of the fiber layers 11 fluffed. When the fibers of the fiber layers 11 are all fluffed up, the mop 10 assumes an almost cylindrical shape as a whole and exhibits increased dust trapping ability owing to the increased effective area (contact area with a surface of an object to be cleaned). The fiber layers 11 can be fluffed by, for example, blowing air to the fiber layers 11 to raise and fuzz the fiber bundles.

According to the structure of the mop 10 of the first embodiment, the first fiber layers 11, which are the closest to the respective pocket-forming sheets 13 of all the fiber layers 11, are joined to the pocket-forming sheets 13 by the central linear seal 16A continuously extending in the longitudinal direction in the laterally middle portion and by the side seals 16B spacedly aligned in the longitudinal direction at positions laterally spaced away in both lateral directions from the central linear seal 16A.

The part of each first fiber layer 11A which is joined to the pocket-forming sheet 13 by only the continuous central linear seal 16A forms tufts of the fiber bundle (tow) inside in the thickness direction in the laterally middle portion of the mop 10. Outside each first fiber layer 11A in the thickness direction there is the second fiber layer 11B joined to the pocket-forming sheet 13 by only the continuous central linear seal 16A. The second fiber layer 11B interferes with the first fiber layer 11A standing upright. Because the first fiber layer 11A itself is a fiber aggregate, fibers of the first fiber layer 11A closer to the seal in the thickness direction are more apt to rise upright from the pocket-forming sheet 13, and fibers farther from the seal tend to rise at an angle decreasing from 90 degrees with the distance from the seal.

The other part of the first fiber layer 11A which is joined to the pocket-forming sheet 13 by the continuous central linear seal 16A and the discontinuous side seals 16B also forms tufts near both lateral side edges of the mop 10. In these tufts, too, the fibers show different tendencies in direction of rising depending on their position in the thickness direction. Fibers farther from the pocket-forming sheet 13 rise upright more easily because of the presence of a less amount of the other fibers interfering with rising upright and a more amount of the other fibers reducing the tendency to fall. On the other hand, fibers closer to the pocket-forming sheet 13 are more apt to fall. By virtue of the difference in rising tendencies between fibers, tufts of the fiber bundle (tow) are also formed in the lateral side portions of the mop 10 in such a manner as to hide the seals thereunder.

Each second fiber layer 11B, which is joined to the pocket-forming sheet 13 by only the continuous central linear seal 16A, forms tufts of the fiber bundle (tow) outside in the thickness direction in the laterally middle portion of the mop 10. This is because the second fiber layer 11B is prevented from falling from the upright position, being supported by the part of the first fiber layer 11A which is joined to the pocket-forming sheet 13 only by the continuous central linear seal 16A inside the second fiber layer 11B. Because the second fiber layer 11B itself is a fiber aggregate, fibers of the second fiber layer 11B closer to the seal in the thickness direction are more apt to rise upright from the pocket-forming sheet 13, and fibers farther from the seal tend to rise at an angle decreasing from 90 degrees with the distance from the seal. The above-described tufts formed only by each seal could be formed by providing a plurality of continuous linear seals. When or after a load of cleaning is applied to such tufts, however, the raised fibers tend to fall in the same direction as the fibers preventing falling, and recovery from compression is not expected.

In the present invention, in contrast, because there are a plurality of fiber sealing positions to form tufts in a plurality of patterns, the tufts formed have different patterns of supporting the raised state of the fibers to provide a mop head in which the fibers are raised in different directions in an effective, mutually supportive way. The mutually supportive form of raised fibers effectively functions to exhibit recovery from compression to a good degree even when or after a load of cleaning is applied. By that effect, the surface tufts provide an effective cleaning surface all over the mop. The fibers can further be raised and fluffed up in a mutually supportive manner by air blowing or a like technique so that the entire peripheral surface of the mop 10 may be formed by the tips of the fibers of the tufts as illustrated in FIG. 6.

In the first embodiment, a combination of the above-described effects provides a mop the fiber layers 11 of which exhibit excellent fiber rising capabilities and recovery from compression and which is well conformable to an uneven surface of an object being cleaned and exhibits high cleaning performance.

Figure 7A:
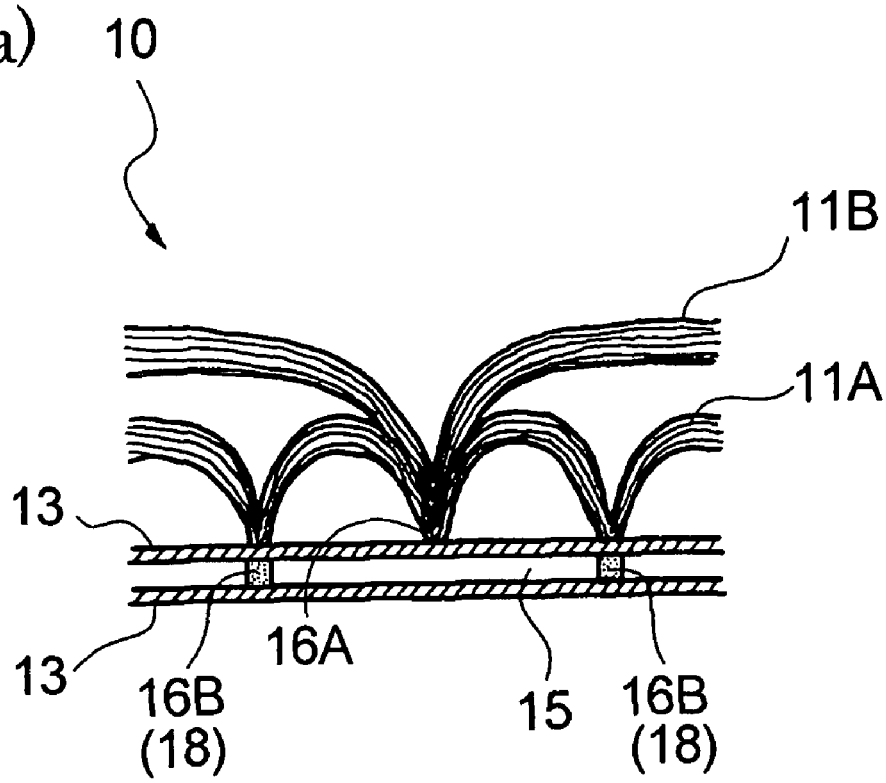
FIG. 7(*a*) is a vertical cross-sectional view of pocket-forming sheets in a second embodiment of the cleaning article according to the present invention, taken in the lateral direction (corresponding to FIG. 4(*a*)).
Figure 7B:
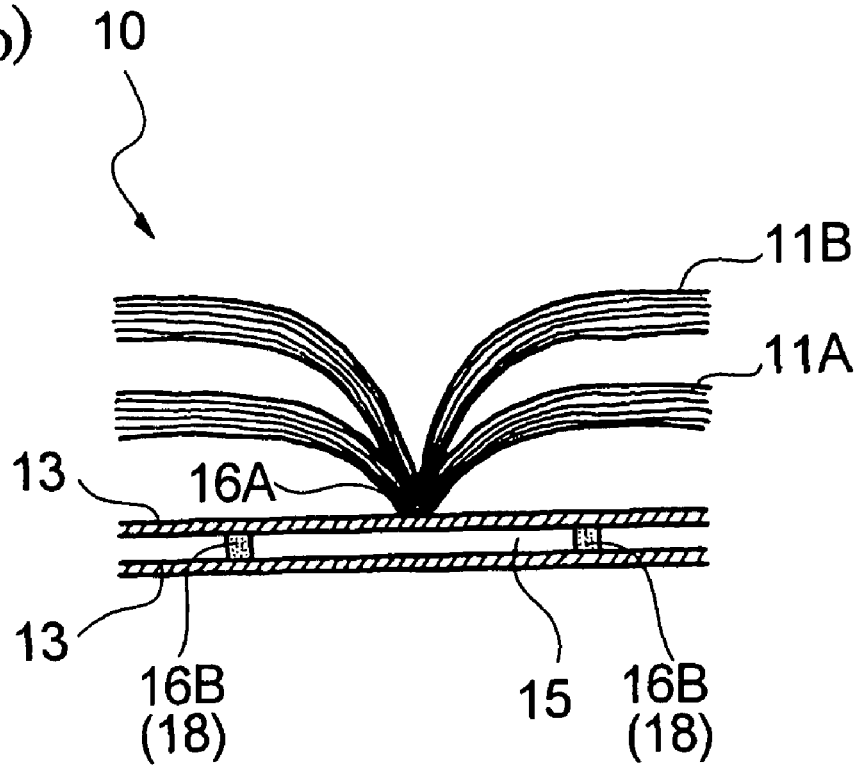

A second embodiment of the cleaning article (mop) according to the present invention will then be described by way of FIGS. 7(*a*), 7(*b*), and 8. Unless specifically described, the description on the first embodiment applies to the second one. Corresponding members in FIGS. 7(*a*), 7(*b*), and 8 are identified with the same numerals as in FIGS. 1 to 6.

Figure 8:
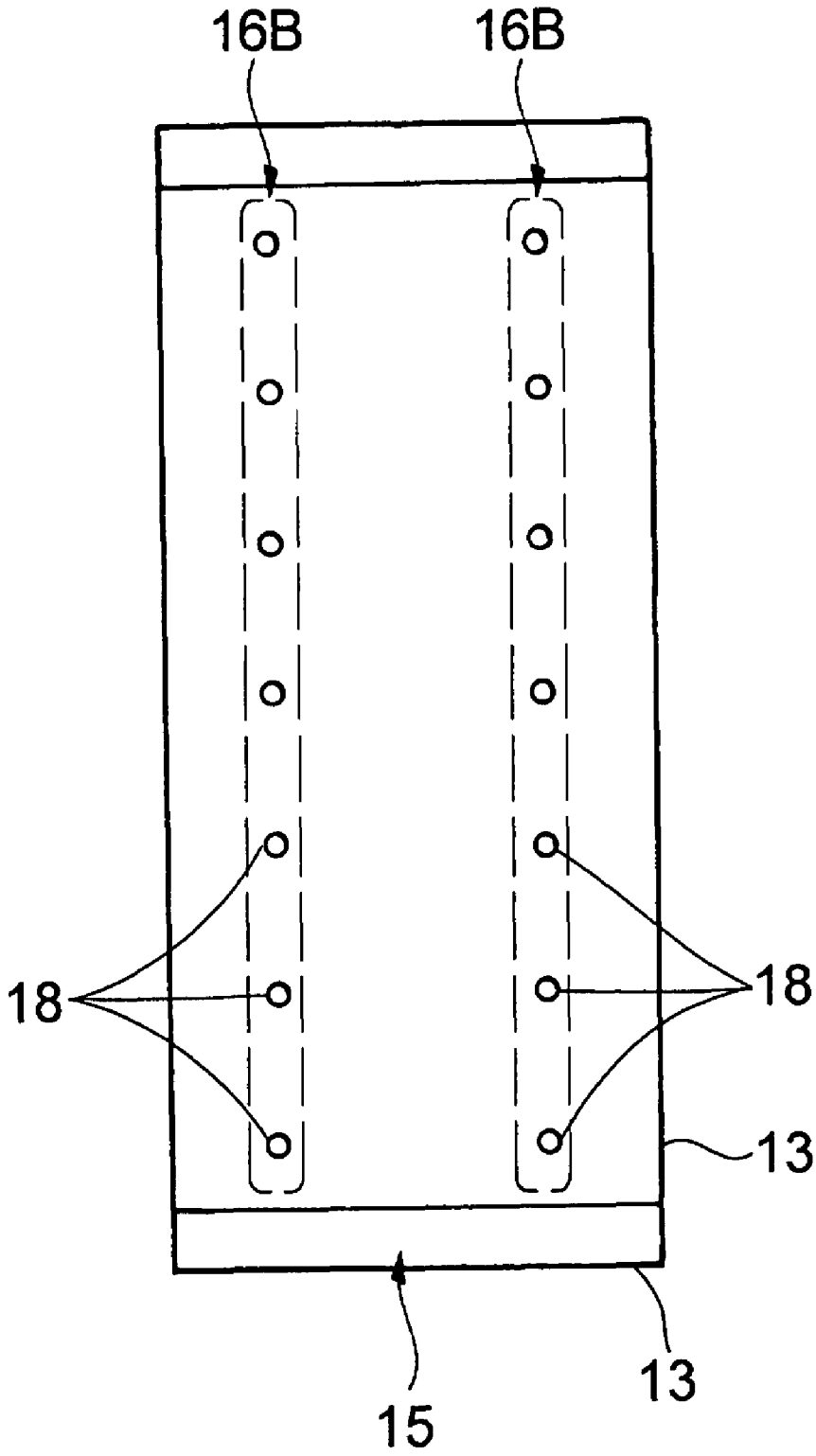
FIG. 8 is a plan view of pocket-forming sheets in the cleaning article shown in FIGS. 7(*a*) and 7(*b*) (corresponding to FIG. 3).

The mop 10 of the second embodiment has only one pocket 15 as illustrated in FIGS. 7(*a*), 7(*b*), and 8. Two pocket-forming sheets 13 of the same oblong shape are joined by two discontinuous side seals 16B extending in the longitudinal direction to form the tubular pocket 15. Each of the two discontinuous side seals 16B (the zones encircled by dotted lines in FIG. 8) is formed by aligning circular heat-sealed dot joints 18 at equal spaces in the longitudinal direction. The continuous central linear seal 16A provided in the mop of the first embodiment is also provided in the second embodiment to join each of the pocket forming sheets 13 and the fiber layers 11 but not to join the two facing pocket-forming sheets 13 together.

Figure 9:
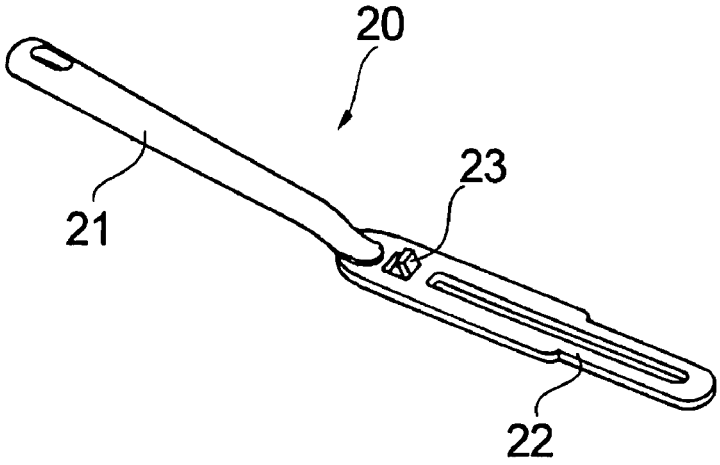
FIG. 9 is a perspective view of another holder.
Figure 10:
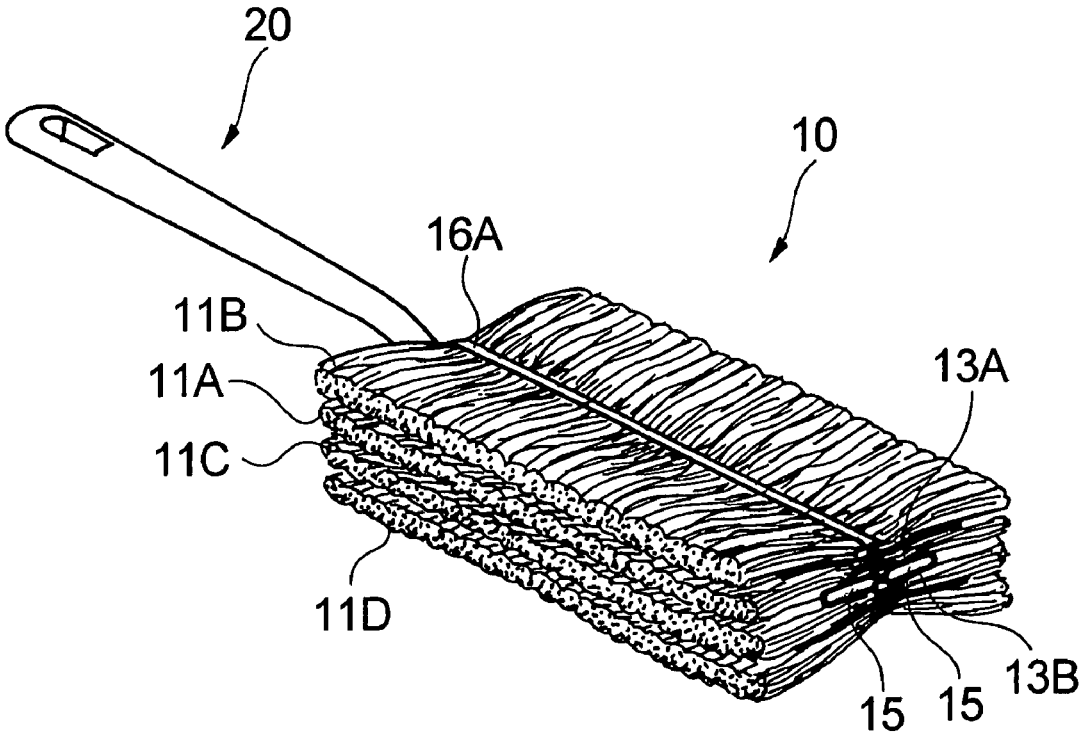
FIG. 10 is a perspective view of a third embodiment of the cleaning article according to the resent invention, attached to a holder.
Figure 11:
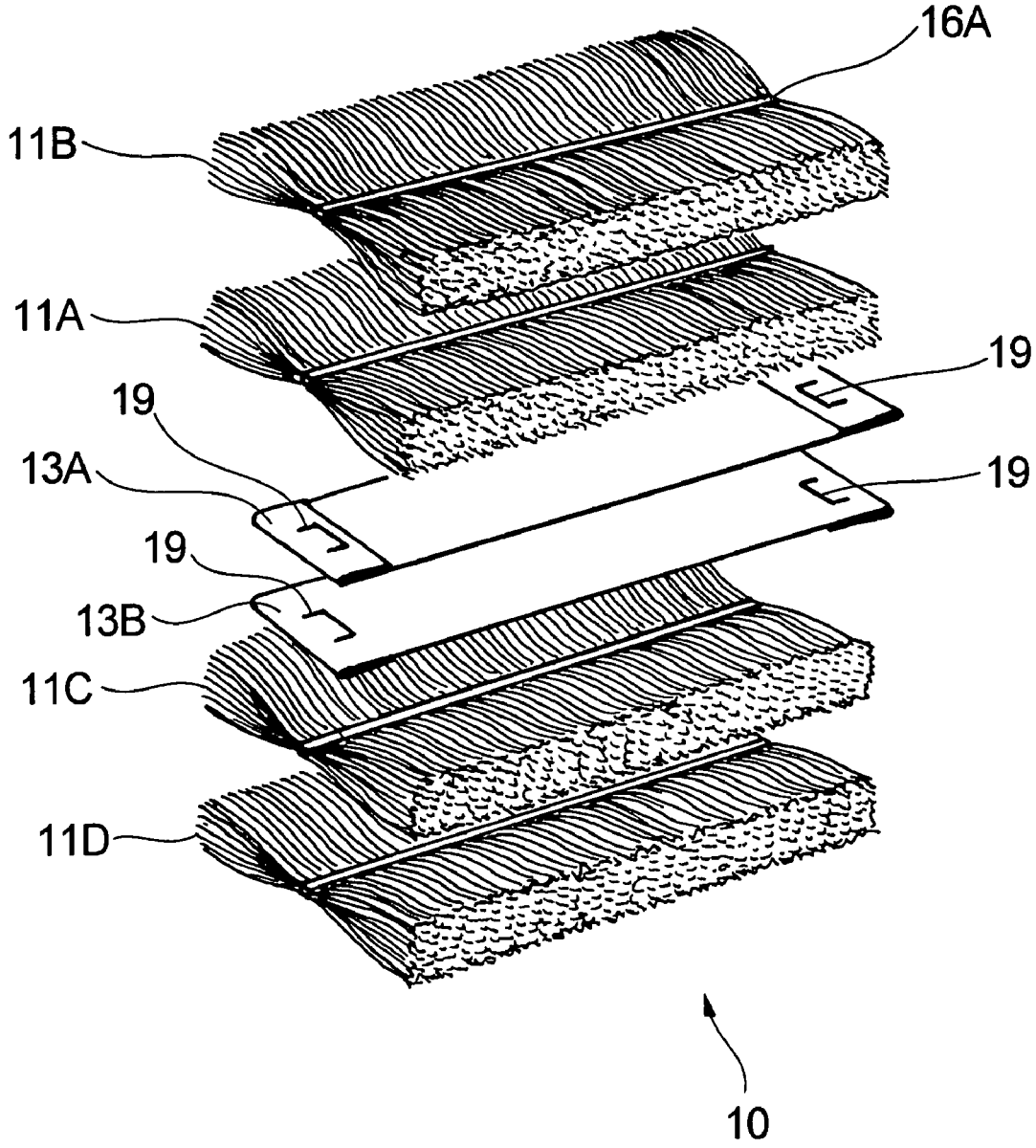
FIG. 11 is an exploded perspective view of the cleaning article of FIG. 10.
Figure 12:
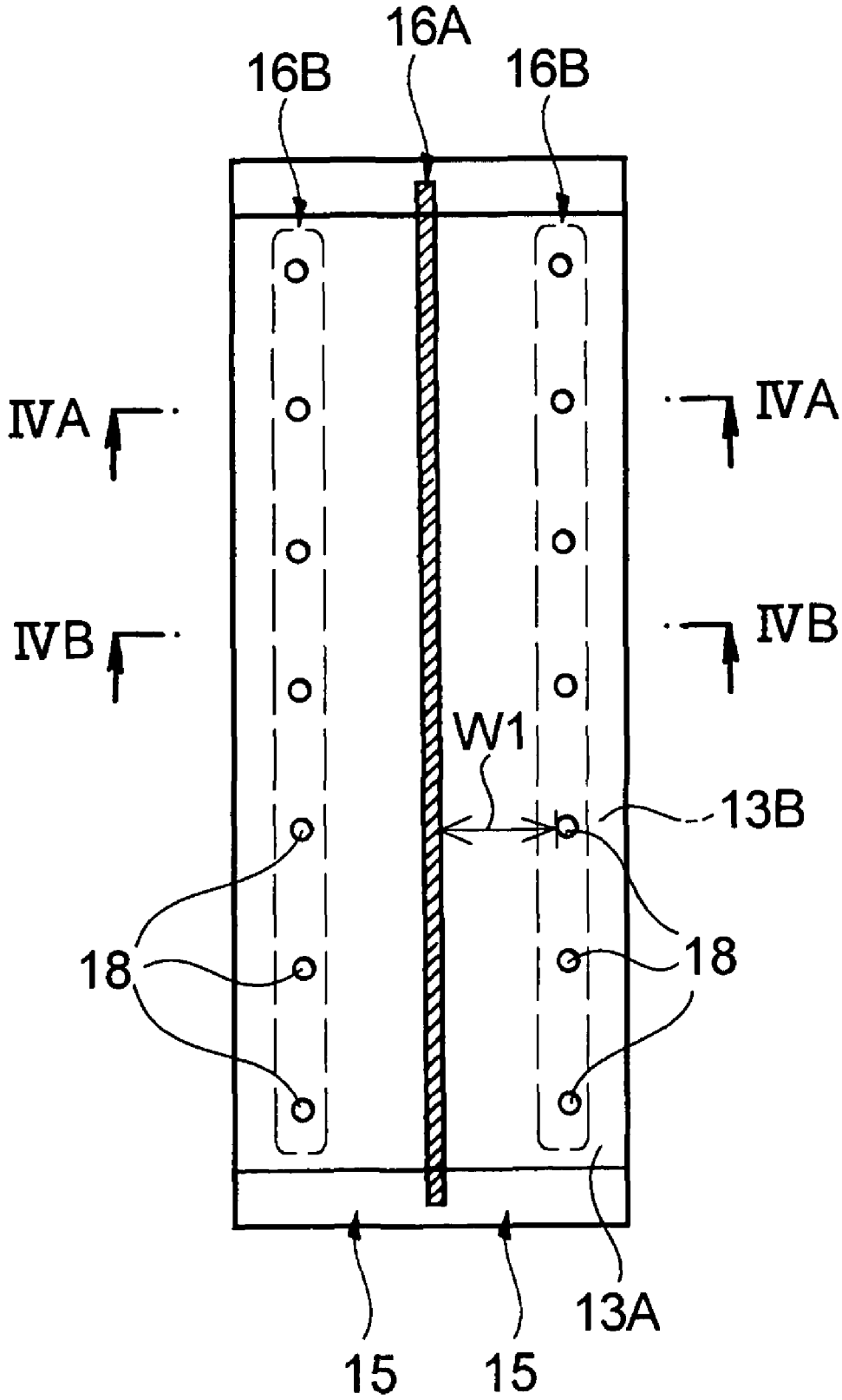
FIG. 12 is a plan view of pocket-forming sheets in the cleaning article of FIG. 10.

The holder 20 to which the mop of the second embodiment is adapted to be attached may be either two-forked as in the first embodiment or nonforked as illustrated in FIG. 9 as long as its width is practically the same as that of the pocket 15.

The second embodiment achieves the same effects as in the first embodiment. Additionally, when the insertion portion of the holder 20 is unforked as illustrated in FIG. 9, the pocket has its rigidity increased by the holder 20 to exhibit improved maneuverability in cleaning hard-to-reach spaces such as corners of rooms and gaps between walls and furniture or scraping tough dirt off a surface of an object being cleaned.

A third embodiment of the cleaning article (mop) according to the present invention will then be described by way of the drawing. Unless specifically described, the description on the first embodiment applies to the third one.

As illustrated in FIGS. 10 to 13(*c*), the mop 10 according to the third embodiment is oblong and flat as a whole and has a pair of flat tubular pockets 15 adjacent to each other in the lateral direction thereof. The mop 10 of the third embodiment is attachable to a holder having a pair of insertion portions 22 illustrated in FIG. 5 by inserting the paired insertion portions 22 into the paired pockets 15.

In what follows, the terms "longitudinal direction" and "lateral direction" means the longitudinal direction (the direction of insertion) and lateral direction of the pockets 15, respectively, unless otherwise specified.

The pockets 15 are formed by joining two facing pocket-forming sheets 13A and 13B by making joining zones 16A and 16B extending to delineate both longitudinal sides of the pockets 15. More specifically, the pockets 15 are formed by joining the two facing pocket-forming sheets—a first pocket-forming sheet 13A and a second pocket-forming sheet 13B—by a continuous central linear seal 16A and discontinuous side seals 16B at prescribed positions (described later in detail).

At least one fiber layer 11 formed of a fiber bundle is disposed on each of the upper and lower sides of the pockets 15, i.e., the facing pocket-forming sheets 13. In the third embodiment, two fiber layers 11, i.e., a first fiber layer 11A and a second fiber layer 11B are disposed on the upper side of the pockets 15 and two other fiber layers 11, i.e., a third fiber layer 11C and a fourth fiber layer 11D are disposed on the lower side of the pockets 15.

Numerical reference 13 will be used in describing particulars common to the first pocket-forming sheet 13A and second pocket-forming sheet 13B. Numerical reference 11 will be used in describing the first fiber layer 11A, second fiber layer 11B, third fiber layer 11C, and fourth fiber layer 11D in common. In describing the first fiber layer 11A and third fiber layer 11C in common, these layers will be identified with term "inner fiber layers 11P". In describing the second fiber layer 11B and fourth fiber layer 11D in common, these layers will be identified with term "outer fiber layers 11Q".

The first fiber layer 11A and third fiber layer 11C are closer to the pocket-forming sheets 13 than any other fiber layers 11. The second fiber layer 11B and fourth fiber layer 11D are layers present on the outer side of the first fiber layer 11B and third fiber layer 11C, respectively. Accordingly, the mop 10 of the third embodiment has a stack of four fiber layers, i.e., the second fiber layer 11B, first fiber layer 11A, the third fiber layer 11C, and fourth fiber layer 11D in the order from the upper to lower sides.

As is understandable from comparison between the first and third embodiments with respect to the stack of four fiber layers, the upper-sided second fiber layer 11B and first fiber layer 11A and the lower-sided first fiber layer 11A and second fiber layer 11B in the first embodiment correspond to the second fiber layer 11B, first fiber layer 11A, third fiber layer 11C, and forth fiber layer 11D in the third embodiment, respectively. In different phraseology, the inner fiber layers 11P (the first fiber layer 11A and the third fiber layer 11C) as referred to in the third embodiment correspond to the term "first fiber layer(s)" as used in the present invention, and the outer fiber layers 11Q (the second fiber layer 11B and fourth fiber layer 11D) correspond to the term "second fiber layer(s)" as used in the present invention.

The fiber layers 11 are each formed of an oriented fiber bundle with a prescribed thickness. The fiber bundle is substantially oriented in the lateral direction of the pockets 15. Accordingly, the first fiber layer 11A to the fourth fiber layer 11D are stacked with the fiber orientation direction perpendicular to the longitudinal direction of the pocket-forming sheets 13. The fiber layers 11 are each nearly rectangular in a plan view and of substantially the same shape.

It is preferred to apply an oil component such as liquid paraffin to the fibers to render the fibers capable of retaining particles such as fine particulate dust. Other useful components than liquid paraffin include those commonly known as oil, such as silicones, poly(ethylene glycol), and polyethylene wax. Adding a surface active agent to these components is effective to improve water absorption, antistatic properties, and the like.

Using colored fibers is effective to improve the product appearance and the visibility of the dust collected.

The pocket-forming sheets 13 are almost rectangular with their longitudinal direction coinciding with the longitudinal direction of the mop 10. The pocket-forming sheets 13 are almost as long as the fiber layers 11 and narrower than the fiber layers 11. In other words, the length of the pocket-forming sheets 13 in the lateral direction is smaller than the length of the fiber layers 11 each formed of a fiber bundle in the lateral direction.

The pocket-forming sheets 13 are flexible in their longitudinal direction and easily conformable to the contour of an object being cleaned. As a result, the fiber layers 11 joined to the respective pocket-forming sheets 13 are also conformable to the contour of an object being cleaned to produce improved dust and dirt trapping effects.

The material forming the pocket-forming sheets 13 can be any of fibrous sheets such as nonwovens employed in conventional cleaning articles. Air-through nonwovens and spun-bonded nonwovens are particularly preferred. Nonwovens, films, synthetic papers and composites of these materials are also useful as the material forming the pocket-forming sheets 13.

The fiber layers 11 and the pocket-forming sheets 13 are stacked with their longitudinal centerlines aligned and joined together over the length of the pocket-forming sheets 13.

In more detail, the first fiber layer 11A is joined to the first pocket-forming sheet 13A by a continuous central linear seal 16A continuously extending in the longitudinal direction in a laterally middle portion and by a discontinuous side seal 16B discontinuously extending in the longitudinal direction and laterally spaced away in both lateral directions from the central linear seal 16A. Similarly, the third fiber layer 11C is joined to the second pocket-forming sheet 13B by a continuous central linear seal 16A and discontinuous side seals 16B.

The second fiber layer 11B and the fourth fiber layer 11D are bonded to the first pocket-forming sheet 13A and the second pocket-forming sheet 13B, respectively, only by the continuous central linear seal 16A in the laterally middle portion.

The continuous central linear seal 16A positioned in the laterally middle portion of the mop 10 is continuous, straight-linear and spans opposite longitudinal ends of the pocket-forming sheets 13. The lateral position of the continuous central linear seal 16A can also be said to be the laterally middle portion of the pocket-forming sheets 13.

At least one of the two pocket-forming sheets 13 has a length of 100% or more of the length of the fiber layers 11 in the direction of insertion. In view of ease of checking the position of inserting a holder 20 and ease of inserting the holder 20, it is preferred that both the first and second pocket-forming sheets 13A and 13B be longer than the fiber layers 11. It is preferred that the longitudinal ends of the pocket-forming sheets 13 extend outward from the longitudinal ends of the fiber layers 11 by 1 to 40 mm, more preferably 1 to 30 mm.

When a user uses the mop 10 for cleaning while grasping the holder 20, it is likely that only the distal portion of the mop 10 is soiled. Noting this tendency and in order to make full use of the entire cleaning surface, it is effective to provide the mop 10 with another pair of inlets for inserting the holder 20 from the opposite direction to the insertion direction illustrated in FIG. 10, i.e., from the right to the left in FIG. 10. The mop 10 of the third embodiment has that structure as described later. In that case, it is preferred that the pocket-forming sheets 13 extend outward from the longitudinal ends of the fiber layers 11 at both longitudinal ends thereof.

In the end portions of the pockets 15 (in the extensions from the fiber layers 11 in the third embodiment), the pocket-forming sheets 13 preferably remain unjoined together by at least 1 mm, more preferably 5 mm or longer, to provide ease of attachment.

A discontinuous side seal 16B (the zone encircled by broken lines in FIG. 12) is provided at each outward position in the lateral directions of the continuous central linear seal 16A.

The discontinuous side seal 16B consists of 2 to 100 dot joints 18 spacedly aligned in the longitudinal direction. The number of the dot joints 18 making up the discontinuous seal is preferably 2 to 50. In the third embodiment, the dot joints 18 are circular, heat-sealed joints that are equally spaced in the longitudinal direction. The positions of the dot joints 18 in the longitudinal direction are symmetrical about the longitudinal centerline of the pocket-forming sheets. To avoid a holder 20 catching in the spaces between the dot joints 18 during inserting in the pockets 15, the distance between the dot joints in the longitudinal direction is preferably 5 to 40 mm.

The distance W1 (see FIG. 12) between the continuous central linear seal 16A and the discontinuous side seal 16B in the lateral direction is preferably 5 to 90 mm, more preferably 5 to 45 mm.

The distance W1 is a distance between the inboard edge of the individual dot joints 18 forming the discontinuous side seal 16B and the outboard edge of the continuous central linear seal 16A measured in the lateral direction of the pocket-forming sheets 13 overlying each other. In the third embodiment, the distance W1 is the width of each of the pockets 15.

The total length of the dot joints 18 in the discontinuous side linear seal 16B (the length of the side seal 16B exclusive of the spaces between the dot joints 18 as measured in the longitudinal direction) is preferably 10% or more, more preferably 15% or more, of the length of the part of the inner fiber layers 11P that overlies the pockets 15. The above-defined total length of the dot joints 18 in each of the discontinuous side linear seals 16B is preferably 10% or more, more preferably 15% or more, of the length of the part of the continuous central linear seal 16A that is along beside the pockets 15.

The facing pocket-forming sheets 13 are not bonded to each other nor to the respective inner fiber layers 11P in regions between every dot joints 18 of the discontinuous side seals 16B as will be described later in detail.

The shape of the individual dot joints 18 may be elliptic, rectangular, etc. The dot joints 18 may be spaced at irregular intervals in the longitudinal direction.

Figure 13A:
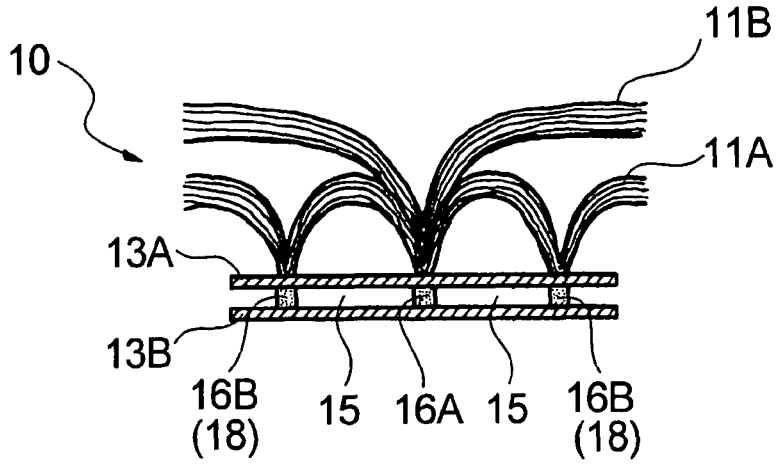
FIG. 13(*a*) is a cross-sectional view taken along line IVA-IVA in FIG. 12.
Figure 13B:
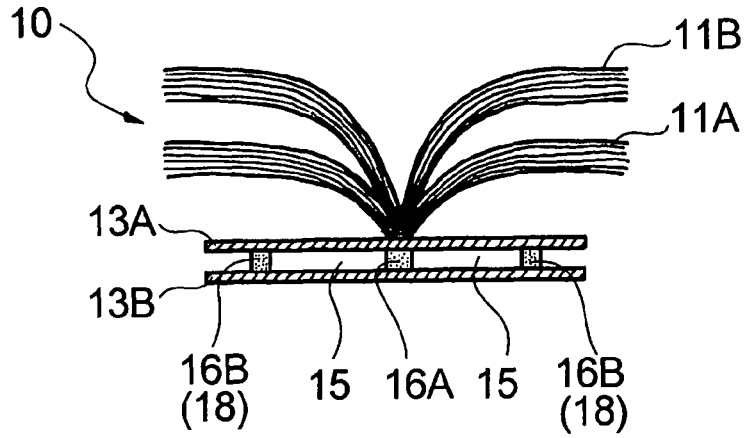
Figure 13C:
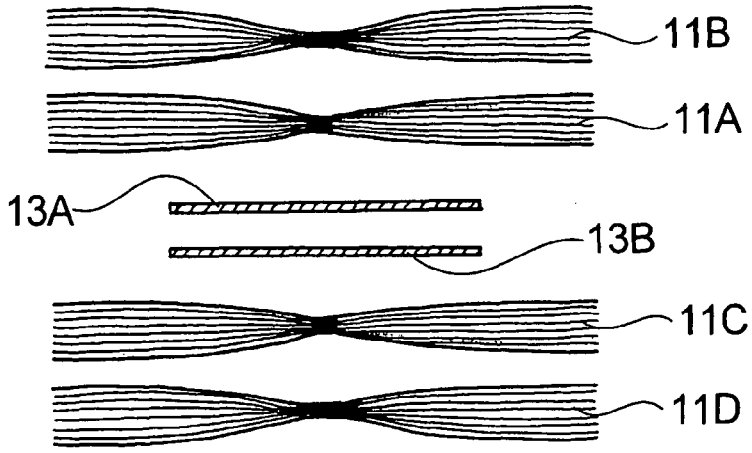

Seen in vertical cross-sectional views taken in the lateral direction, the inner fiber layers 11P are joined to the respective pocket-forming sheets 13 at three joints—the central joint 16A and two side joints 16B —as represented by FIG. 13(*a*) or at only one joint—the central joint 16A —as represented by FIG. 13(*b*). Seen in a vertical cross-sectional view taken along any plane in the lateral direction, the outer fiber layers 11Q are joined at only one joint—the central joint 16A—as illustrated in FIGS. 13(*a*) and 13(*b*). In FIGS. 13(*a*) and 13(*b*), the third fiber layer 11C and fourth fiber layer 11D are not depicted.

It is preferred that the lateral side edges of the fiber layers 11 extend beyond the lateral side edges of the pocket-forming sheets 13 as illustrated in FIG. 13(*c*). The pocket-forming sheets 13 are preferably retracted from at least one of lateral side edges of the inner fiber layers 11P by 1 to 20 mm, more preferably 2 to 15 mm.

Because in the third embodiment the pocket-forming sheets 13 are narrower than the fiber bundles forming the fiber layers 11 in the lateral direction of the mop, it is only the fiber layers 11 that exist on the outer surface of the mop 10. Furthermore, because there are a plurality of fiber sealing positions to form tufts in a plurality of patterns, in which the fibers are raised in different directions, the fibers can easily rise to take on a mutually supportive form upon being subjected to a fluffing treatment such as air blowing. It is therefore possible to provide a mop 10 the entire peripheral surface of which is formed by the tips of the fibers of the tufts as illustrated in FIG. 6. In this case, it is preferred that the fiber layers 11 be fluffed into an almost cylindrical shape to cover the entire peripheral surface of the mop 10 while hiding the continuous central linear seals 16A.

The state of the fiber layers 11 fluffed into an almost cylindrical shape as illustrated in FIG. 6 can be achieved preferably by the method of fluffing according to the present invention. The method of fluffing according to the present invention starts with providing a cleaning article (mop) 10 having a flat tubular pocket 15 and including a fiber layer 11 formed of a fiber bundle bonded to each of the upper and lower sides of the pocket 15 by a continuous central linear seal 16A. The mop 10 is attachable to a holder 20 by inserting the holder 20 into the pocket 15. The method includes the step of opening the fiber layers 11 each formed of the fiber bundle to randomly in three dimensions to fluff the fiber layers 11 into an almost cylindrical shape hiding the continuous central linear seals 16A. The step of opening the fiber layers 11 can be effected by, for example, air blowing.

The continuous central linear seal 16A and the discontinuous side seals 16B are formed by known joining means such as heat sealing or adhesion with an adhesive. In the case where the pocket-forming sheets 13 are made out of heat fusible fibers, the continuous central linear seal 16A and the discontinuous side seals 16B may be formed by thermal fusion bonding.

The pair of flat tubular pockets 15 are formed by joining the facing pocket-forming sheets 13 by the three seals—the discontinuous side seal 16B on one side, the continuous central linear seal 16A, and the discontinuous side seal 16B on the other side. That is, the three seals—the discontinuous side seal 16B on one side, the continuous central linear seal 16A, and the discontinuous side seal 16B on the other side—serve for sealing the facing pocket-forming sheet 13 not only with each other but with the fiber layers 11.

The pockets 15 spans the whole length of the pocket-forming sheets 13. The pocket-forming sheets 13A and 13B are in contact with each other without a holder inserted therebetween. On inserting the holder 20 thereinto, the pocket-forming sheets 13A and 13B are separated apart to form a tubular space.

The pockets 15 each have an inlet at both longitudinal ends of the pocket-forming sheets 13 so that a holder 20 can be inserted into the pockets 15 from whichever inlet.

The mop 10 of the third embodiment is used for cleaning as attached to the holder 20 of FIG. 5 with the paired insertion portions 22 of the holder 20 inserted into the respective pockets 15.

In order for the holder 20 to be inserted into the respective pockets 15 with ease and but not to come off the respective pockets 15 during a cleaning operation, it is preferred that the width of each pocket 15 be substantially equal to that of each insertion portion 22 of the holder 20. Having the insertion portion 22 therein, the pocket 15 expands laterally by the thickness of the insertion portion 22 and thereby constricts the insertion portion 22.

Each of the pocket-forming sheets 13 is folded back over its outer side to form a turnback cuff at both longitudinal ends thereof. The cuff is fixed to the outer side of the pocket-forming sheet 13 at its laterally middle position by the continuous central linear seal 16A.

Each of the pocket-forming sheets 13 has a slit cut 19 in both the longitudinal end portions as an engaging means engageable with the hook 23 of the holder 20.

The slit 19 has the shape of a U letter. On engaging the slit 19 with the hook 23, the flap portion of the sheet 13 created by the U-shaped cutting is capable of opening upward and outward with respect to the longitudinal direction of the sheet 13. On engaging the slit 19 with the hook 23, the holder 20 is restricted from moving in the longitudinal direction in the pockets 15, particularly in the unsheathing direction. The mop 10 is thus stably held by the holder 20.

Since the slits 19 are cut in each of the facing pocket-forming sheets 13A and 13B, the mop 10 can be attached to the holder 20 with the insertion portions 22 inserted into the respective pockets 15, whichever the hook 23 is on the upper side or the lower side of the mop 10.

While in the third embodiment the pockets 15 and the fiber layers 11 have substantially the same length (in the direction of insertion), there are cases, while not shown, in which it is preferred in view of ease of attachment that the pocket-forming sheets 13 be longer than the fiber layers 11 so that the pockets 15 may be longer than the fiber layers 11.

It is preferred to reinforce the ends of the pocket-forming sheets 13 by known reinforcing means so as to help a user pinch the ends and to prevent the pinched ends from breaking in attaching the mop 10 to the holder 20. In the third embodiment, both opposite ends of each two pocket-forming sheet 13 are reinforced by folding over the outer side of the pockets 15 to gain in breaking strength.

Another example of the means for increasing the sheet breaking strength is making the pocket-forming sheets 13 out of heat fusible fibers and fusing the ends of the sheets 13 into cohesive film-like end portions. Still another example is bonding another sheet material to the end portions of the pocket-forming sheets 13.

When a slit 19 is cut as an engaging means engageable with the holder 20 as previously stated, it is preferred to reinforce the periphery of the slit by the above-mentioned reinforcing means.

According to the structure of the mop 10 of the third embodiment, each the inner fiber layers 11P, which are the closest to the pocket-forming sheets 13 of all the fiber layers 11, is joined to the respective pocket-forming sheet 13 by the central linear seal 16A continuously extending in the longitudinal direction in the laterally middle portion and by the side seals 16B spacedly aligned in the longitudinal direction at a position laterally spaced away in both lateral directions from the central linear seal 16A.

Therefore, the part of each of the inner fiber layers 11P which is joined to the pocket-forming sheets 13 by only the continuous central linear seal 16A forms tufts of the fiber bundle (tow) inside in the thickness direction in the laterally middle portion of the mop 10.

The other part of each of the inner fiber layers 11P which is joined to the pocket-forming sheet 13 by not only the continuous central linear seal 16A but also the discontinuous side seals 16B also forms tufts near both lateral side edges of the mop 10.

The outer fiber layers 11Q which are bonded to the pocket-forming sheets 13 only by the respective continuous central linear seals 16 also form tufts of the fiber bundle (tow) outside in the thickness direction in the laterally middle portion of the mop 10.

When, as in the present invention, there are a plurality of fiber sealing positions to form tufts in a plurality of patterns, the tufts formed have different patterns of supporting the raised state of the fibers to provide a mop head in which the fibers are raised in different directions in an effective, mutually supportive way. The mutually supportive form of raised fibers effectively functions to exhibit recovery from compression to a good degree even when or after a load of cleaning is applied. By that effect, the surface tufts provide an effective cleaning surface all over the mop. The fibers can further be raised and fluffed up in a mutually supportive manner by air blowing or a like technique so that the entire peripheral surface of the mop 10 may be formed by the tips of the fibers of the tufts as illustrated in FIG. 6. In that case, it is preferred that the tips of the tufts cover all over the surface of the mop 10, hiding the continuous central linear seals 16A.

In the third embodiment, a combination of the above-described effects provides a mop the fiber layers 11 of which exhibit excellent fiber rising capabilities and recovery from compression during a cleaning operation and which is well conformable to an uneven surface of an object being cleaned and exhibits high cleaning performance.

Since the pocket-forming sheets 13 are shorter than the fiber bundles forming the fiber layers 11 in the lateral direction of the mop, it is only the fiber layers 11 that exist on the surface of the mop. Thus, the fiber bundles function more effectively to exhibit enhanced cleaning capabilities. For example, the fiber bundles are highly conformable to the surface of an object being cleaned and therefore superior in ability to clean uneven surfaces. Furthermore, the mop is useful to clean delicate objects requiring special handling.

A fourth embodiment of the cleaning article (mop) 10 according to the present invention will be described by way of FIG. 14, in which like members are identified with the same numerals as in FIGS. 5, 6, and 10 to 13(*c*). Unless specifically described, the description on the third embodiment applies to the fourth one.

Figure 14:
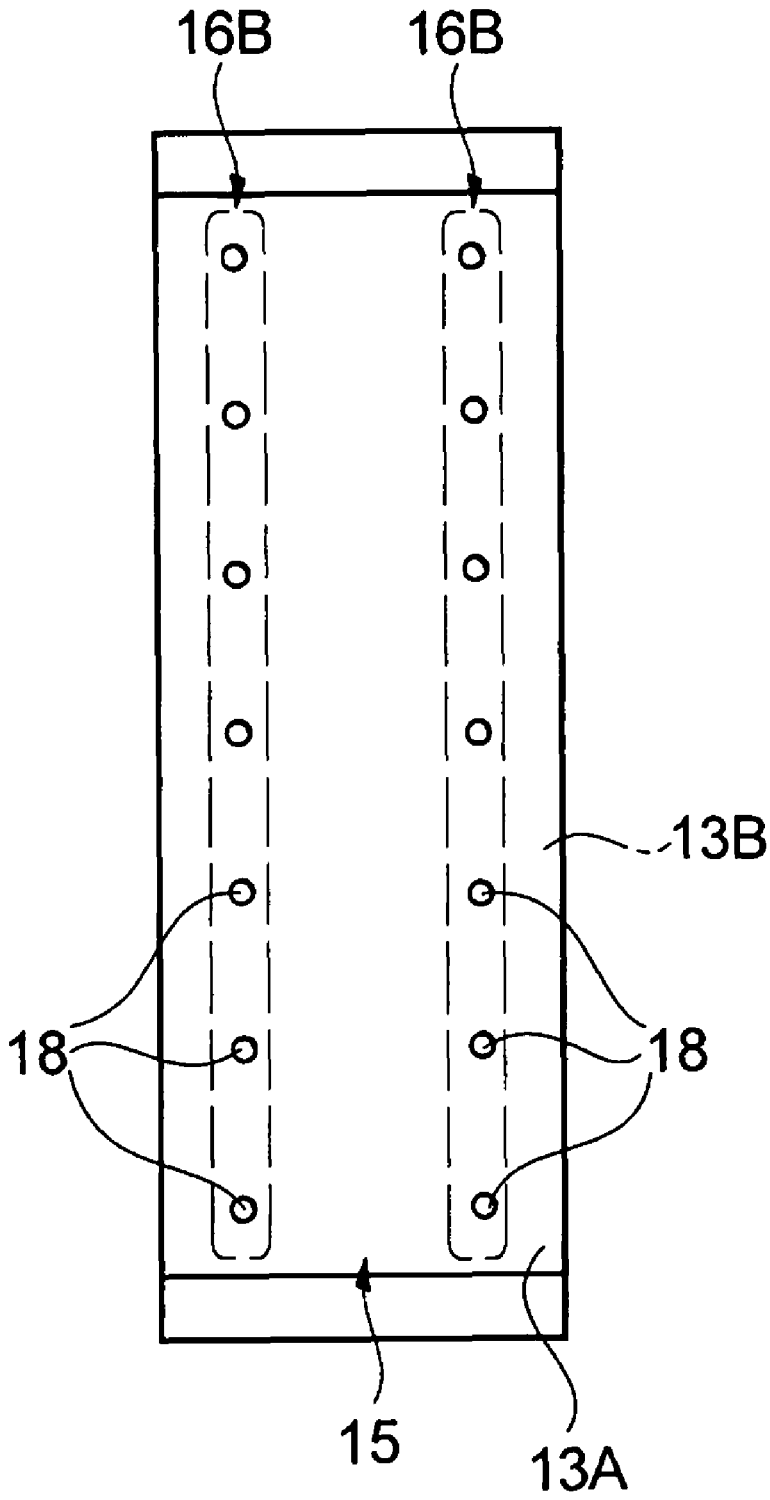
FIG. 14 is a plan view of pocket-forming sheets in a fourth embodiment of the cleaning article according to the present invention (corresponding to FIG. 12).

The mop 10 of the fourth embodiment has only one pocket 15 as illustrated in FIG. 14. Two pocket-forming sheets 13A and 13B of the same oblong shape are joined by two discontinuous side seals 16B extending in the longitudinal direction to delineate the tubular pocket 15. Each of the two discontinuous side seals 16B (the zones encircled by broken lines in FIG. 14) is formed by aligning circular, heat-sealed dot joints 18 at equal spaces in the longitudinal direction. The continuous central linear seal 16A provided in the mop of the third embodiment is also provided in the fourth embodiment to join each of the pocket forming sheets 13 and the fiber layers 11 but not to join the two facing pocket-forming sheets 13 together.

The holder 20 to which the mop of the fourth embodiment is to be attached may be either two-forked as illustrated in FIG. 5 or nonforked as in FIG. 9 as long as its width is practically the same as that of the pocket 15.

The fourth embodiment achieves the same effects as in the third embodiment. Additionally, when the insertion portion of the holder 20 is unforked as illustrated in FIG. 9, the pocket has its rigidity increased by the holder 20 to exhibit improved maneuverability in cleaning hard-to-reach spaces such as corners of rooms and gaps between walls and furniture or scraping tough dirt off a surface of an object being cleaned.

Figure 15A:
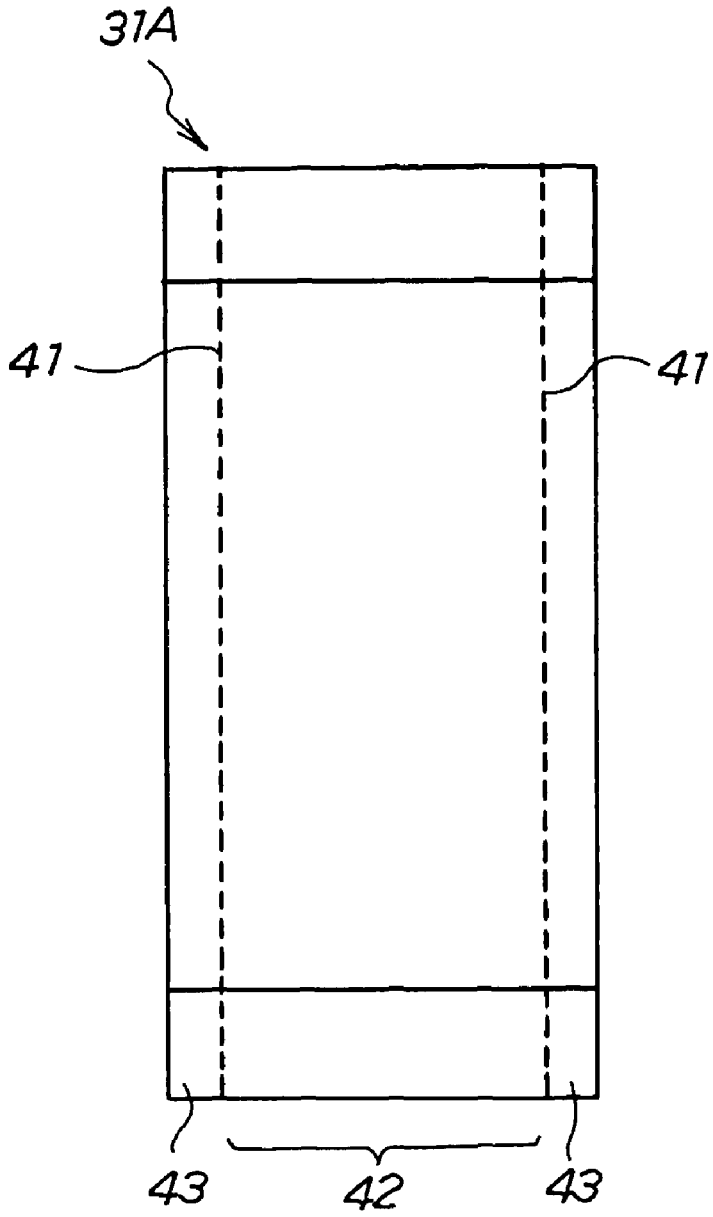
FIG. 15(*a*) is a plan view of an individual first member used in a first embodiment of the method of producing a cleaning article according to the present invention.
Figure 15B:
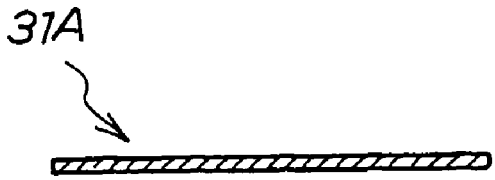
Figure 19:
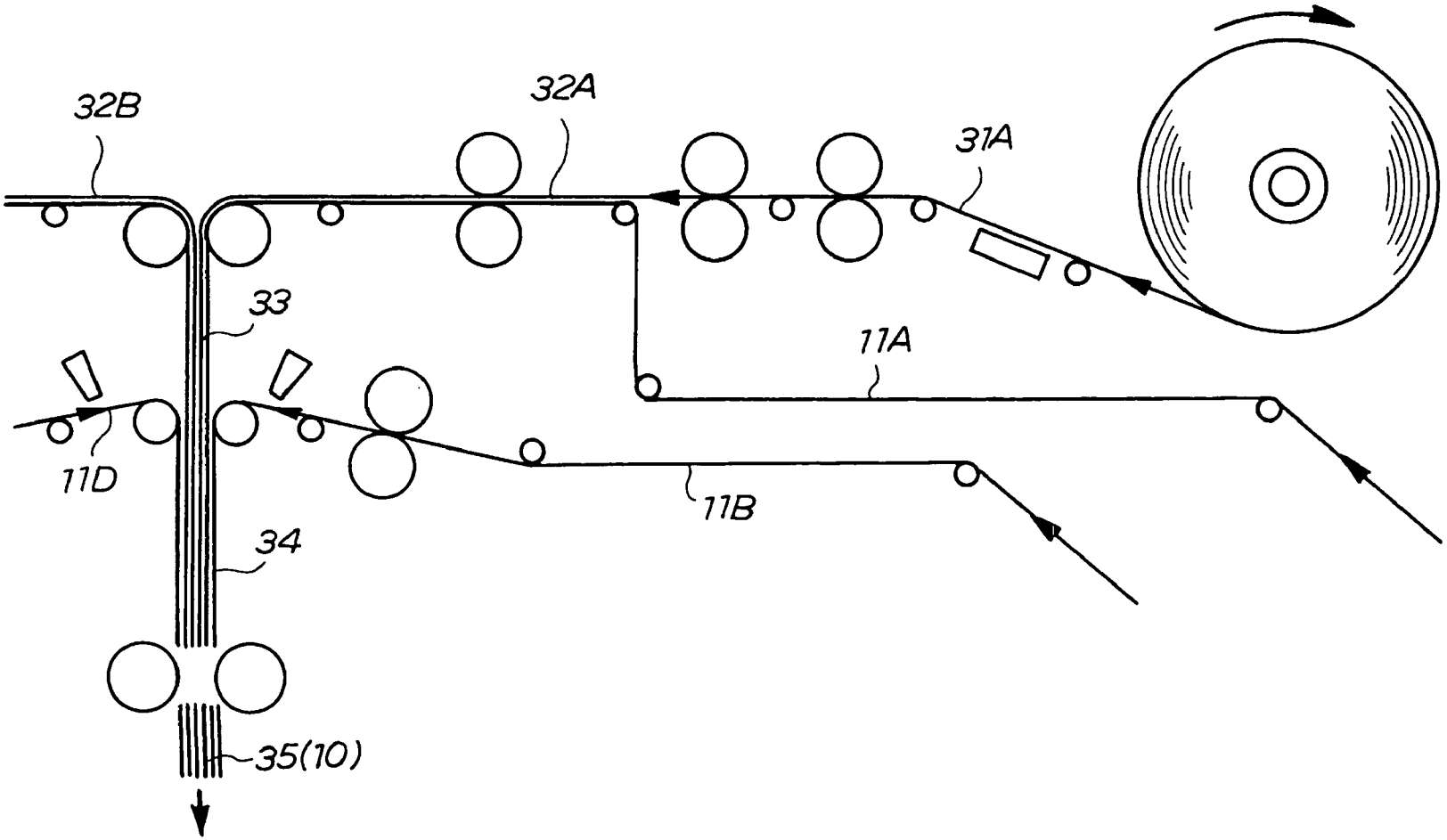
FIG. 19 schematically illustrates the first embodiment of the method of producing a cleaning article according to the present invention.
Figure 20A:
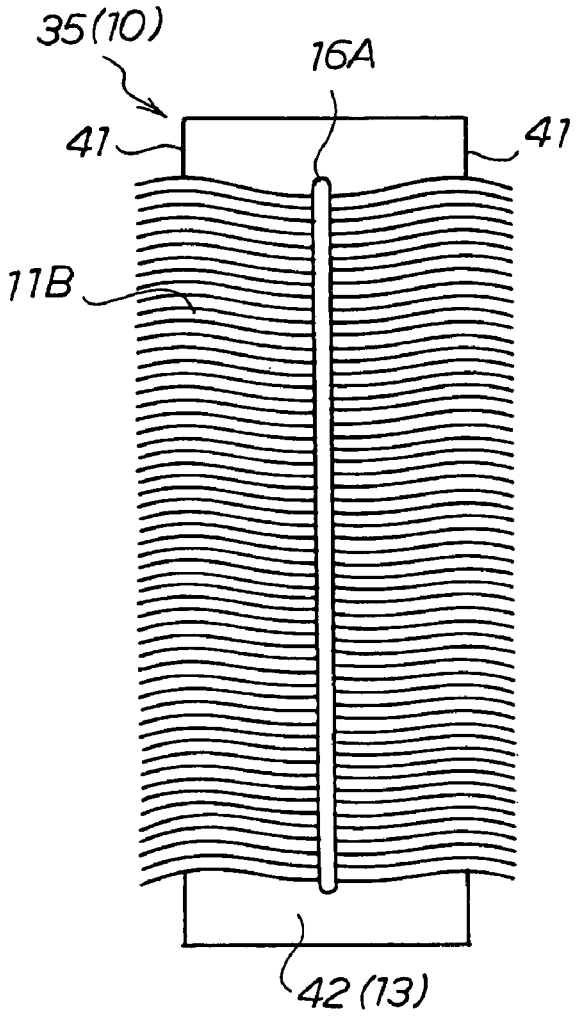
FIG. 20(*a*) is a plan view of an individual cleaning article produced by the first embodiment of the method of producing a cleaning article according to the present invention.
Figure 20B:
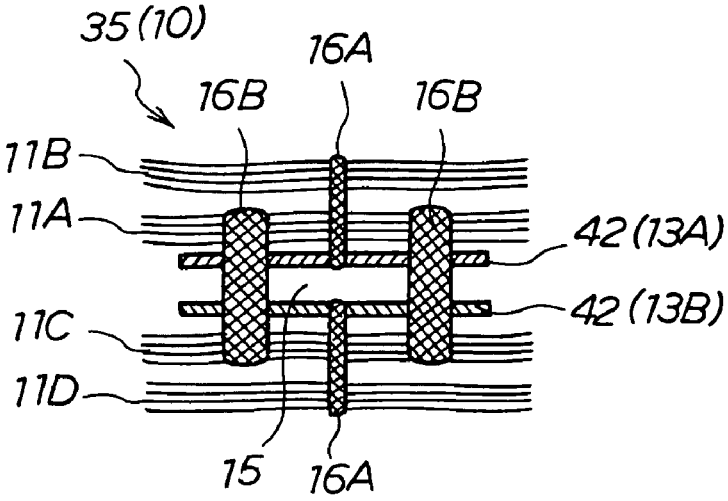

The method of making a cleaning article according to the present invention will now be described taking, for instance, the production of the mop 10 of the fourth embodiment shown in FIG. 14. FIGS. 15(*a*) through 20(*b*) will be referred to. In FIG. 19, the step for making a second continuous form subassembly 32B is substantially identical with the step for making a first continuous form subassembly 32A and is therefore not shown.

According to the present embodiment of the method, the mop 10 is produced through the following steps (1) to (5):

(1) Step of making a first and a second continuous form subassembly.

(2) Step of making a continuous form assembly including substeps of mating and joining the first and second continuous form subassemblies to each other and overlaying a second fiber layer and a fourth fiber layer each formed of a continuous fiber bundle on the first and second continuous form subassemblies, respectively.

(3) Step of cutting the continuous form assembly into individual cleaning articles.

(4) Step of tearing a first and a second member of the individual cleaning articles along a pair of tear-off lines having been provided on opposite lateral sides of the first and second members to remove tear-off portions outboard of the tear-off lines while leaving a middle portion between the paired tear-off lines.

(5) Step of splitting the fiber layers of the individual cleaning articles to fluff the fiber layers randomly in three dimensions.

(1) Step of making a first and a second continuous form subassembly

In what follows, reference is made only to a first continuous form subassembly 32A. A second continuous form subassembly 32B is prepared in the same manner as for the first one.

In step (1), a first fiber layer 11A formed of a continuous fiber bundle is overlaid on a first member 31A formed of a continuous nonwoven fabric web and fixed thereto by intermittently forming continuous linear seals 16A to make a first continuous form subassembly 32A (hereinafter simply referred to as "first subassembly 32A") as illustrated in FIGS. 15(*a*) to 16(*b*) and 19. Step (1) is usually carried out before step (2) in which a second fiber layer 11B formed of a continuous fiber bundle is overlaid and joined to make a continuous form assembly 34 (hereinafter referred to as "assembly 34").

Figure 16A:
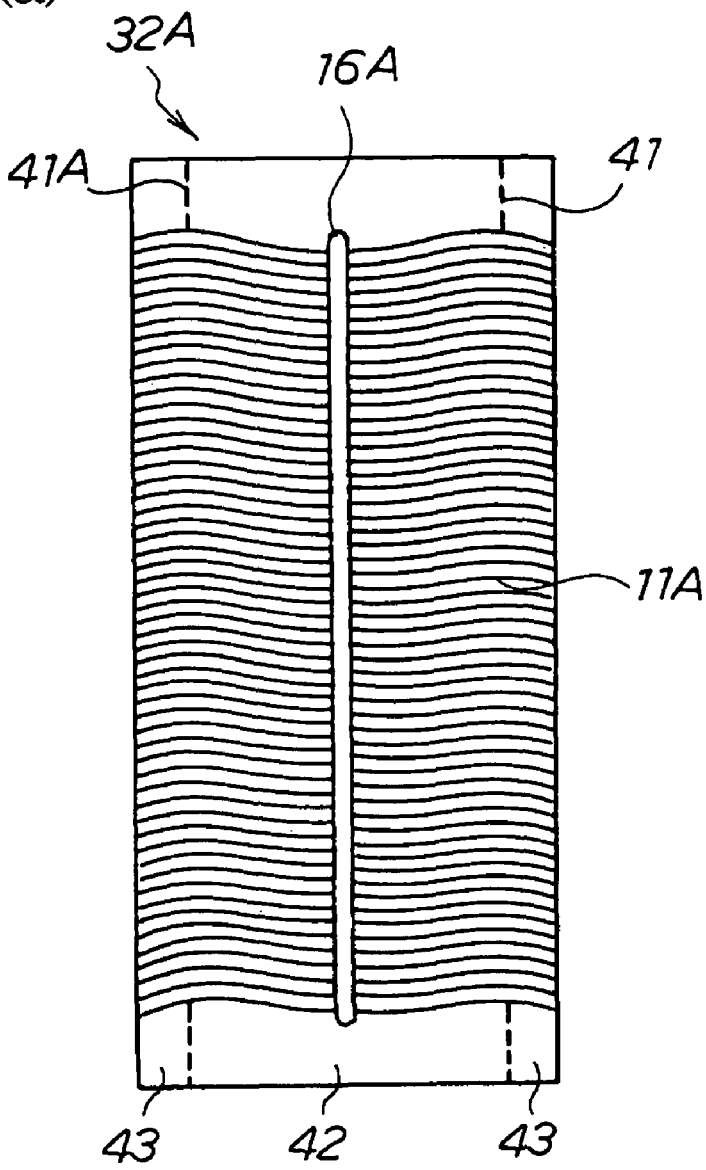
FIG. 16(*a*) is a plan view of an individual first subassembly in the first embodiment of the method of producing a cleaning article according to the present invention.
Figure 16B:
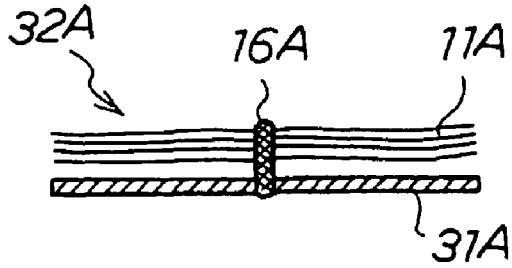

In step (1), a first member 31A formed of a continuous nonwoven fabric web is fed from a stock roll as illustrated in FIG. 19. As illustrated in FIGS. 15(*a*) and 15(*b*), the web is folded back along both edges thereof (at both longitudinal ends of the individual first member 31A) and joined to itself, and then perforated to form tear-off lines 41 across the whole width of the web (extending the whole length of the individual first member 31A) at intervals in the machine direction. The first member 31A is thus sectioned into middle portions 42 between every pair of tear-off lines 41 and outer tear-off portions 43 connected to outboard of every middle portion 42 via each tear-off line 41. As illustrated in FIGS. 16(*a*), 16(*b*), and 19, a first fiber layer 11A formed of a continuous fiber bundle is fed on the outer side of the first member 31A and joined thereto by continuous central linear seals 16A to obtain a first subassembly 32A. The continuous central linear seals 16A are provided across the whole width of the first subassembly 32A at intervals in the machine direction.

In that way, perforation lines (tear-off lines) 41 are formed in the first member 31A prior to overlaying the first fiber layer 11A to help tear the first member 31A without damaging the fiber layer 11 in step (4) in which a first member 31A is cut along a pair of tear-off lines 41 to remove the tear-off portions 43 outboard of the tear-off lines 41 while leaving the middle portion 42 between the pair of tear-off lines 41.

(2) Step of making an assembly including substeps of mating and joining the first and second subassemblies with each other and overlaying a second fiber layer and a fourth fiber layer each formed of a continuous fiber bundle on the first and second subassembly, respectively.

Figure 17A:
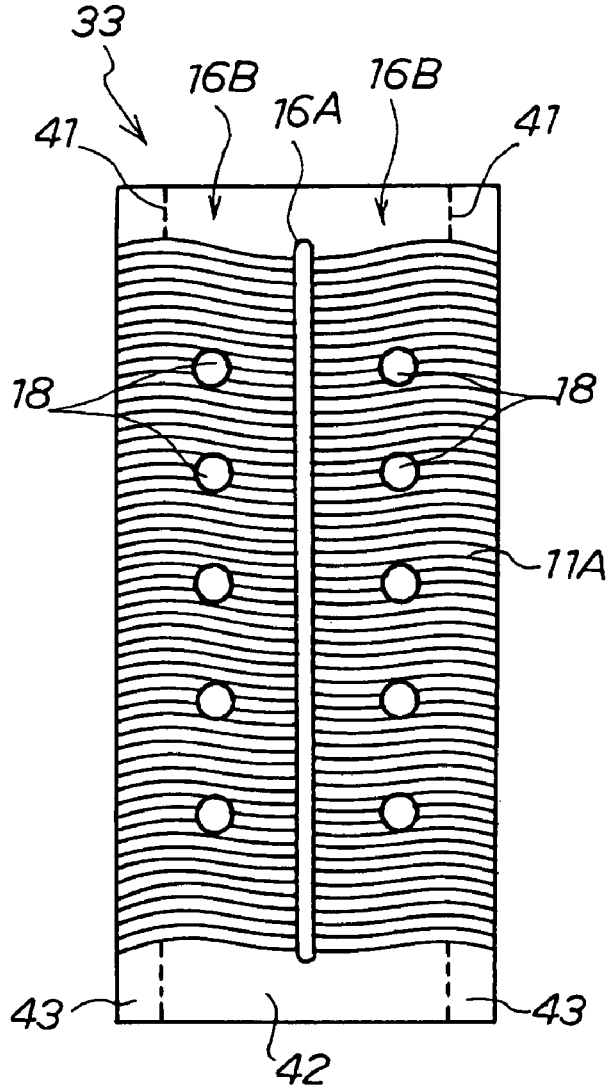
FIG. 17(*a*) is a plan view of an individual stack of the first subassembly and a second subassembly in the first embodiment of the method of producing a cleaning article according to the present invention.
Figure 17B:
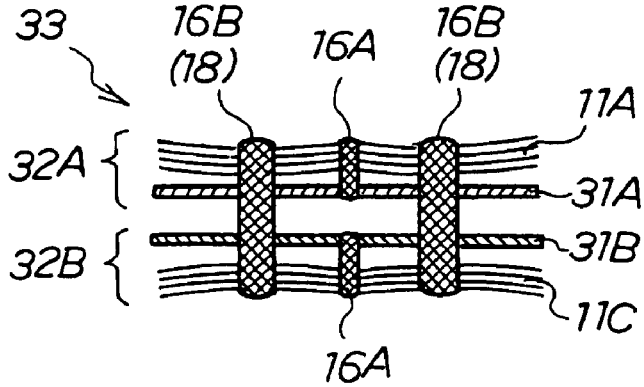

In step (2), as illustrated in FIGS. 17(*a*) to 19, the first subassembly 32A and the second subassembly 32B are mated and joined with each other. A second fiber layer 11B and a fourth fiber layer 11D are then overlaid on the first subassembly 32A and the second subassembly 32B, respectively, to obtain a assembly 34.

In step (2), as illustrated in FIGS. 17(*a*), 17(*b*), and 19, the first subassembly 32A and the second subassembly 32B are separately fed, superposed on each other, and joined together by discontinuous side seals 16B to obtain a structure 33 of continuous form. The discontinuous side seals 16B extend transversely across the first fiber layer 11A and the third fiber layer 11C and are provided at intervals in the machine direction. In order to secure the inlets of the pockets 15, it is preferred that the dot joints of the discontinuous side seals 16B be spaced farther apart in the machine direction in the vicinity of the inlets of the pockets 15.

Figure 18A:
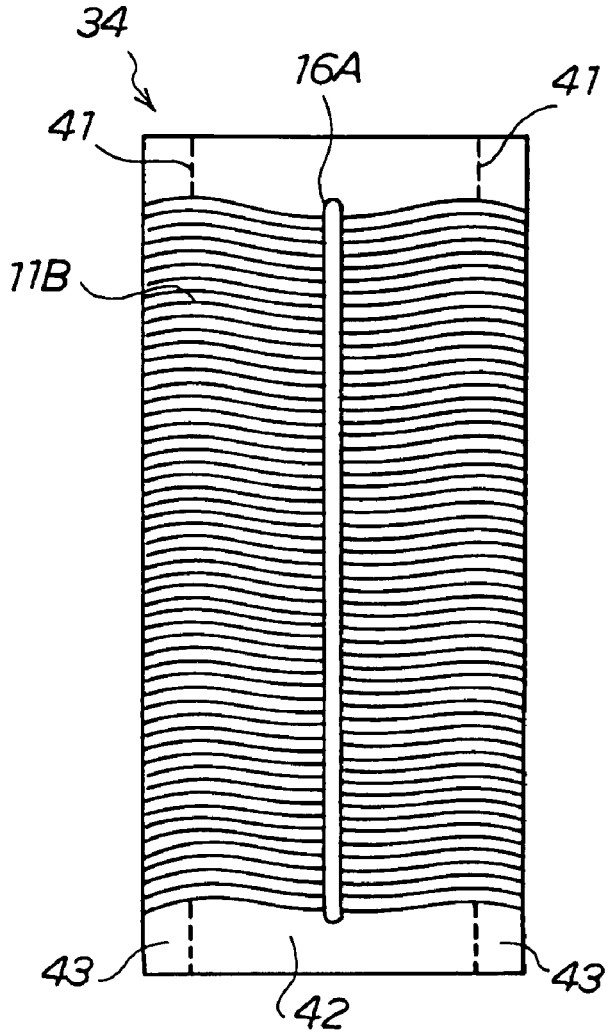
FIG. 18(*a*) is a plan view of an individual assembly prepared in the first embodiment of the method of producing a cleaning article according to the present invention.
Figure 18B:
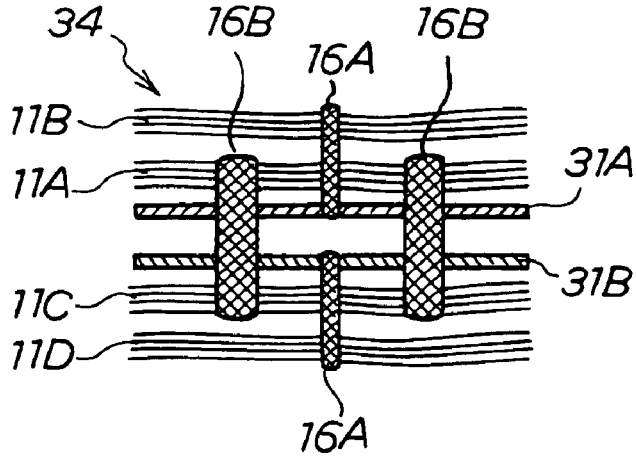

As illustrated in FIGS. 18(*a*), 18(*b*), and 19, the second fiber layer 11B formed of a continuous fiber bundle is overlaid on the first subassembly 32A and fixed by the continuous central linear seals 16A, and the fourth fiber layer 11D is overlaid on the second subassembly 32B and fixed by the continuous central linear seals 16A. The fixing operations are conducted unreleasably by known joining means, such as heat sealing or ultrasonic sealing. The fixing may be partial joining by a large number of dot joints, lattice pattern joints, spiral pattern joints, etc. The fixing may also be achieved by adhesion with a hot melt adhesive. There is thus obtained an assembly 34 having the four continuous form fiber layers, the first fiber layer 11A, third fiber layer 11C, second fiber layer 11B, and fourth fiber layer 11D, fixed at intervals in the machine direction.

(3) Step of cutting the continuous form assembly into individual cleaning articles In step (3), the assembly 34 of continuous length is cut into individual cleaning articles 35 as illustrated in FIG. 19. The numerical reference 35 indicates an unfinished cleaning article.

(4) Step of tearing a first and a second member of the individual cleaning articles along the pair of tear-off lines to remove tear-off portions outboard of the tear-off lines while leaving the middle portion between the tear-off lines.

In step (4), as illustrated in FIGS. 18(*a*), 18(*b*), 20(*a*), and 20(*b*), the first member 31A and the second member 31B are torn along the previously formed pair of tear-off lines 41 to remove the tear-off portions 43 outboard of the tear-off lines 41 and to obtain the middle portion 42 between the pair of tear-off lines 41. A cleaning article (mop) 10 is thus obtained. The middle portion 42 left after removal of the tear-off portions 43 corresponds to the pocket-forming sheets 13. The space between the facing pocket-forming sheets 13A and 13B is the pocket 15.

(5) Step of splitting the fiber layers of the individual cleaning articles to fluff the fiber layers randomly in three dimensions Step (5) is the final step of the method. In step (5) the fiber layers 11 of the cleaning article 10 (i.e., with the middle portion 42 left between the tear-off lines 41 after tearing off the tear-off portions 43) are splitted and fluffed by blowing air to provide a mop 10 the whole peripheral surface of which is covered with the tips of fiber tufts so that the continuous central linear seals 16A are hidden.

The mop 10 can be thus produced in an efficient manner.

The production method according to the present embodiment preferably further includes the following step (6).

(6) Step of reinforcing the middle portion 42 of the first member 31A and/or the second member 31B at least in the vicinity of the tear-off lines 41.

Step (6) is carried out before forming continuous central linear seals 16A in the first subassembly 32A and the second subassembly 32B at intervals and before, during or after forming the tear-off lines 41 in the first subassembly 32A and the second subassembly 32B at intervals. More specifically, while step (6) can be performed before, during or after the substep of intermittently forming the tear-off lines 41, it should be done before the substep of intermittently forming the continuous central linear seals 16A. Should the continuous central linear seals 16A be formed before step (6), the tear-off lines 41 would be hidden by the first fiber layer 11A and the third fiber layer 11C.

In step (6) either one of or both of the first member 31A and the second member 31B can be reinforced. At least a part of every middle portion 42 near the tear-off lines can be reinforced. The reinforced part is preferably inboard with respect to every pair of the tear-off lines 41. More preferably, a part 3 to 20 mm inboard from, and inclusive of, each of the paired tear-off lines 41 is reinforced.

The reinforcement of the first member 31A and the second member 31B can be carried out by, for example, fusing part of the first and second members into a cohesive film-like portion or applying an adhesive, such as a hot melt adhesive, to part of the first and second members. The fusing into a cohesive film-like portion or the adhesive application may be done to either one of or both of the first member 31A and the second member 31B. In the latter case, the reinforced parts of the two members are preferably bonded to each other.

The mop produced by the method including step (6) has an increased dust scraping force along the lateral edges of the pocket-forming sheets 13 because the middle portion 42 of the first member 31A and/or the second member 31B has been reinforced in the vicinity of the tear-off lines 41.

The mop according to the present invention is not limited to the foregoing embodiments, and various changes and modifications can be added thereto without departing from the spirit and scope of the invention.

The number of the fiber layers 11 may be one (i.e., only the first fiber layer) or more than two per pocket-forming sheet 13.

The pocket 15 may be formed by folding a single pocket-forming sheet 13 into two and bonded at a predetermined position. In other words, the pocket 15 may be formed of a single pocket-forming sheet 13 interposed between upper and lower fiber layers 11 by making joints delineating both lateral sides of the pocket 15.

Figure 21:
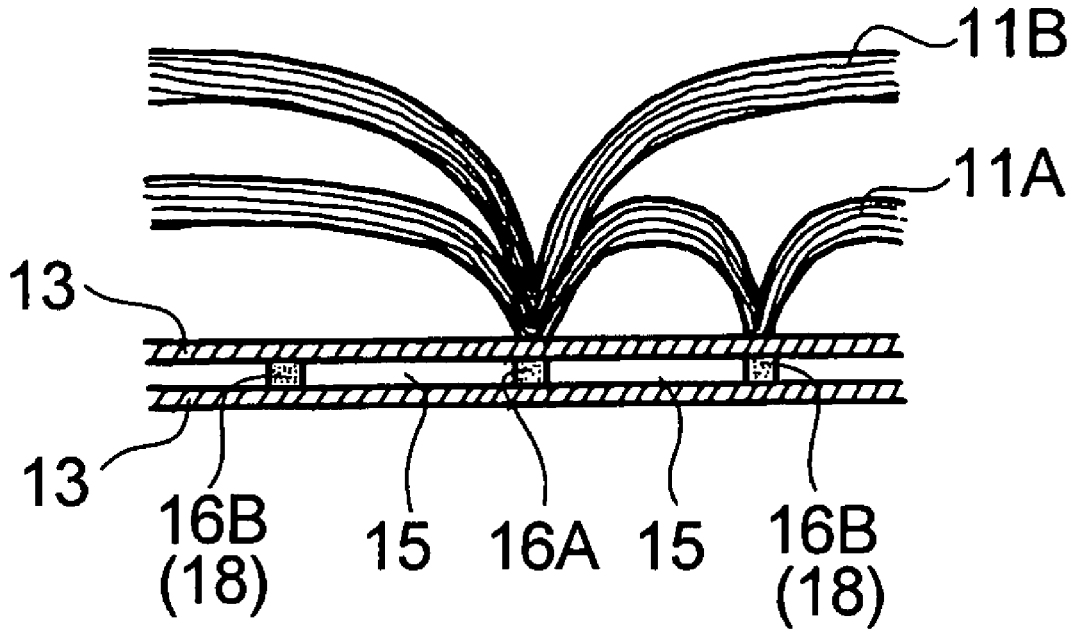
FIG. 21 is a cross-sectional view illustrating a modified bonding configuration between a pocket-forming sheet and fiber layers (corresponding to FIG. 4(*a*)).

The longitudinal positions of dot joints 18 making up the discontinuous side seals 16B do not need to be symmetrical about the longitudinal centerline. In the case of asymmetrical configuration, the first fiber layer 11A shows another pattern of tufts in a vertical cross-sectional view as illustrated in FIG. 21, in which it is joined at two positions—the continuous central linear seal 16A and the discontinuous side seal 16B (dot joint 18) on either side of the seal 16A The discontinuous side seal 16B may be formed on only one outboard side of the continuous central linear seal 16A.

The mop 10 may have more than two pockets 15 as long as insertion portions 22 of a holder 20 are insertable therein. The form of the holder 20 is not restricted.

Figure 22A:
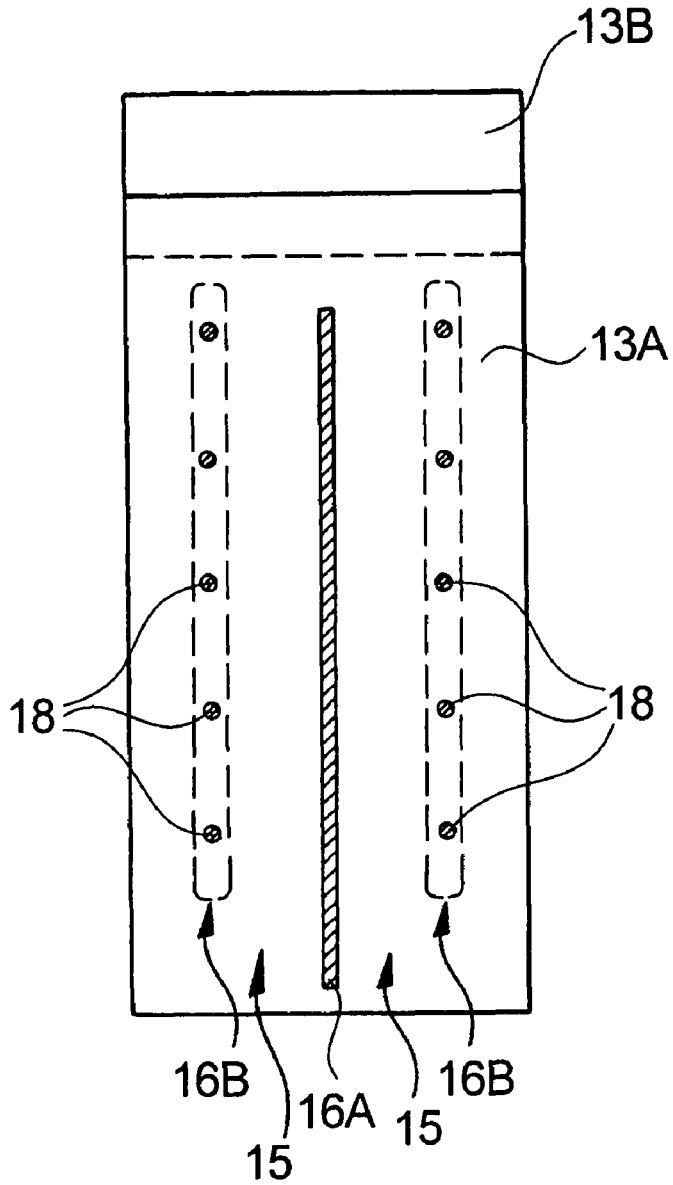
FIG. 22(*a*) is a plan view of pocket-forming sheets of another embodiment (corresponding to FIG. 12).
Figure 22B:
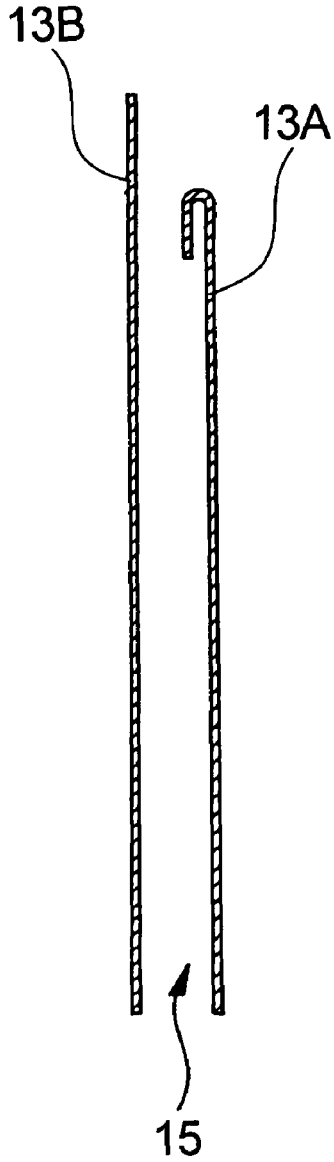

The pocket-forming sheets 13A and 13B may be superposed on each other and joined together with their longitudinal ends uneven as illustrated in FIGS. 22(*a*) and 22(*b*).

The method of fluffing a cleaning article and the method of producing a cleaning article according to the present invention are not limited to the foregoing embodiments, and various changes and modifications can be added thereto without departing from the spirit and scope thereof.

For example, the method of producing a cleaning article according to the present invention is applicable to the production of a cleaning article having two pockets 15 as in the third embodiment of the cleaning article and the production of a cleaning article having more than two pockets 15 as well.

INDUSTRIAL APPLICABILITY

The cleaning article according to the present invention is superior in cleaning performance because the fiber layers thereof exhibit high rising and fluffing capabilities and recovery from compression, the cleaning article is highly conformable to an uneven surface of an object being cleaned and is entirely covered with the fiber tips contributory to cleaning. Moreover, the cleaning article is developed with due consideration for user's convenience and is capable of cleaning with both the upper and lower sides thereof in cleaning tight spaces.

According to the fluffing method of the present invention, the fiber layers of a cleaning article can be fluffed up efficiently.

According to the production method of the present invention, a cleaning article can be produced efficiently.

The invention claimed is:

1. A cleaning article having a flat tubular pocket and attachable to a holder by inserting the holder into the pocket, the pocket being formed by joining a first facing pocket-forming sheet and a second facing pocket-forming sheet, the cleaning article comprising at least a first fiber layer and a second fiber layer formed of a fiber bundle on each of an upper and a lower outer side of the pocket formed by the pocket-forming sheets, the first fiber layers closest to the pocket-forming sheets are joined to each of the respective upper and lower outer side of the pocket formed by the pocket-forming sheets by a continuous central linear seal extending in the longitudinal direction in a laterally middle portion and a discontinuous side seal extending in the longitudinal direction at a position laterally spaced away in at least one of the lateral directions from the continuous central linear seal, wherein the continuous central linear seal is disposed on each of the upper and lower outer sides of the pocket, the second fiber layer is further disposed over each of the first fiber layers, and the second fiber layer is joined to the respective first and second facing pocket-forming sheets only by the continuous central linear seal in the laterally middle portion, and the fibers of the first and second fiber layers are all fluffed up such that the cleaning article has a substantially cylindrical shape.

2. The cleaning article according to claim 1, wherein a width of the pocket-forming sheets is smaller than a width of the fiber layers in the lateral direction of the cleaning article, and the cleaning article comprises at least two said discontinuous side seals, the pocket is formed by joining the two facing pocket-forming sheets that are interposed between the first fiber layers joined to each of the upper and lower outer sides of the pocket not at the continuous central linear seal but at the at least two discontinuous side seals, such that the pocket is formed between the at least two discontinuous side seals.

3. The cleaning article according to claim 1, wherein the pocket has a length equal to or larger than the fiber layers in the direction of insertion into the pocket.

4. The cleaning article according to claim 1, wherein the first fiber layers and the second fiber layers are stacked so that the fibers thereof are orientated in a direction substantially perpendicular to a longitudinal direction of the pocket-forming sheets.

5. The cleaning article according to claim 1, wherein the discontinuous side seal consists of a plurality of dot joints, at each dot joint, the upper first fiber layer and the upper pocket-forming sheet are joined with each other, and the lower first fiber layer and the lower pocket-forming sheet are joined with each other, and the upper and lower pocket-forming sheets are joined with each other at each dot joint.

* * * * *